US011617694B2

(12) United States Patent
Hart et al.

(10) Patent No.: US 11,617,694 B2
(45) Date of Patent: Apr. 4, 2023

(54) POWERED WHEELCHAIR MOVER

(71) Applicant: STAXI CORPORATION LIMITED, Vaughan (CA)

(72) Inventors: Andrew Hart, Woodbridge (CA); Lee John Hancox, Williams Landing (AU)

(73) Assignee: STAXI CORPORATION LIMITED, Vaughan (CA)

( * ) Notice: Subject to any disclaimer, the term of this patent is extended or adjusted under 35 U.S.C. 154(b) by 346 days.

(21) Appl. No.: 16/872,635

(22) Filed: May 12, 2020

(65) Prior Publication Data

US 2021/0353477 A1 Nov. 18, 2021

(51) Int. Cl.
*A61G 5/04* (2013.01)
*A61G 5/10* (2006.01)

(52) U.S. Cl.
CPC ..... *A61G 5/047* (2013.01); *A61G 5/1013* (2013.01); *A61G 5/1037* (2013.01); *A61G 5/1051* (2016.11); *A61G 5/1086* (2016.11); *A61G 5/1089* (2016.11)

(58) Field of Classification Search
CPC .... A61G 5/047; A61G 5/1086; A61G 5/1089; A61G 5/1051
See application file for complete search history.

(56) References Cited

U.S. PATENT DOCUMENTS 5,050,695 A 9/1991 Kleinwolterink, Jr.
6,161,848 A 12/2000 Beumer et al.
6,315,306 B1 * 11/2001 Fernie ..... A61G 5/125 280/33.991
6,412,795 B1 7/2002 Beumer et al.
9,913,771 B2 * 3/2018 March ..... B62B 5/0079
10,011,291 B2 7/2018 Johnson et al.
10,131,372 B2 11/2018 Bod
(Continued)

FOREIGN PATENT DOCUMENTS

EP 1842517 A2 10/2007
EP 3434244 A1 1/2019
(Continued)

OTHER PUBLICATIONS

Espacenet: English machine translation of EP1842517, published on Oct. 10, 2017.
(Continued)

*Primary Examiner* — Jacob D Knutson
*Assistant Examiner* — Ryan Edward Hardy
(74) *Attorney, Agent, or Firm* — Philip C. Mendes da Costa; Bereskin & Parr LLP/S.E.N.C.R.L., s.r.l.

(57) ABSTRACT

An apparatus for moving a wheelchair, the apparatus having a base including a drive motor drivingly connected to a drive wheel and a first forwardly extending lower arm member engageable with the wheelchair when the wheelchair is in the engageable position. The first lower arm member is operable between a lowered position in which the first lower arm member is disengaged from the wheelchair and a raised position in which the first lower arm engages the wheelchair. The first lower arm member has a first stop member whereby, when the first lower arm member is in the raised position and engages the wheelchair, and when the wheelchair is on a forwardly extending declined surface, the first stop member inhibits forward motion of the wheelchair.

20 Claims, 26 Drawing Sheets

(56) References Cited

U.S. PATENT DOCUMENTS

| | | | | |
|---|---|---|---|---|
| 10,751,232 | B1 * | 8/2020 | Ilao | A61G 5/1051 |
| 2001/0022244 | A1 * | 9/2001 | Takada | A61G 5/047 180/69.6 |
| 2007/0289787 | A1 * | 12/2007 | Wiff | B62B 5/0026 180/16 |
| 2008/0223649 | A1 * | 9/2008 | Wandeler | A61G 5/047 180/333 |
| 2012/0279789 | A1 * | 11/2012 | Brill | A61G 5/047 180/6.5 |
| 2013/0240271 | A1 * | 9/2013 | Tallino | A61G 5/1054 180/11 |
| 2019/0142661 | A1 * | 5/2019 | Shemer | A61G 5/047 180/11 |

FOREIGN PATENT DOCUMENTS

| | | | |
|---|---|---|---|
| GB | 2223994 | A | 4/1990 |
| GB | 2274265 | A | 7/1994 |
| NL | 2016428 | B1 | 10/2017 |

OTHER PUBLICATIONS

Espacenet: English machine translation of NL2016428B1, published on Oct. 2, 2017.

* cited by examiner

POWERED WHEELCHAIR MOVER

FIELD

This application relates to the field of powered devices for moving wheelchairs.

INTRODUCTION

The following is not an admission that anything discussed below is part of the prior art or part of the common general knowledge of a person skilled in the art.

Wheelchairs are used by persons who have difficulty walking due to illness, injury, old age, or disability. Persons with severe walking impairments may have their own wheelchair, however, there may be persons who do not rely on a wheelchair for everyday mobility and only require the assistance of a wheelchair in certain circumstances. For example, there may be persons who require the assistance of a wheelchair only at an airport, in a hospital, or when in department stores and like establishments. In these circumstances, wheelchairs may be available for public or at least semipublic use. The use of such a wheelchair will now be explained with reference to an airport.

At any moment of the day, a number of wheelchairs are arranged together at a central point, for instance at an entrance of an airport. A passenger arriving at the airport may sit down in one of the wheelchairs, with or without assistance from, for instance, a fellow traveler or an airport employee. Then the user of the wheelchair may proceed to a gate and/or an airplane, where the wheelchair is left behind when the user takes their seat in the airplane. The wheelchair may then be used again by another passenger for another displacement or may be wheeled back empty to the above-mentioned or similar central point in due course.

The known assembly of wheelchairs has the disadvantage that the wheelchairs must be operated by a fellow traveler or an airport employee. This operation has the disadvantage that the operator may become fatigued by pushing the wheelchair and the person in the wheelchair. This may especially be the case for airport employees who operate wheelchairs for long periods of time, moving multiple passengers throughout the span of a work day.

Various wheelchair moving apparatus have been proposed. For example, it has previously been proposed to make a motorized wheelchair mover that can be attached to a wheelchair and be used to push the wheelchair throughout, for example, an airport. However, such movers have the disadvantage of being permanently fixed to the wheelchair which requires each wheelchair to have its own powered mover.

SUMMARY

The following introduction is provided to introduce the reader to the more detailed discussion to follow. The introduction is not intended to limit or define any claimed or as yet unclaimed invention. One or more inventions may reside in any combination or sub-combination of the elements or process steps disclosed in any part of this document including its claims and figures.

In accordance with one aspect of this disclosure, which may be used alone or in combination with any other aspect, there is provided an apparatus for moving a wheelchair wherein the wheelchair is inhibited from being inadvertently detached from the apparatus for moving the wheelchair when the wheelchair is conveyed on a decline by the apparatus. For example, in an airport, the ramp to a plane may be at a decline. Therefore, the passenger may have to be conveyed downhill from the boarding gate to the plane. During such a decent, the wheelchair may be inadvertently detached from the wheelchair moving apparatus, which is dangerous for the wheelchair passenger, as well as other persons who may be nearby. In accordance with this aspect, a stop member may be provided which inhibits forward motion of a wheelchair when the wheelchair is travelling on a decline, such as a stop member that engages a part of the wheelchair if the wheelchair travels forwardly with respect to the wheelchair moving apparatus or that engages the wheelchair when the wheelchair moving apparatus drivingly engages the wheelchair. Accordingly, for example, the wheelchair moving apparatus may have an arm member that has the stop. When the wheelchair moving apparatus is positioned behind a wheelchair, the arm may be rotated (e.g., upwardly or downwardly) and the stop member may be located forwardly of, e.g., a luggage rack or other cross member of a wheelchair.

In accordance with this broad aspect, there is provided an apparatus for moving a wheelchair, the wheelchair having a front end, a rear end and first and second laterally opposed sides, the wheelchair is positionable in front of the apparatus in an engageable position, the apparatus comprising:

(a) a base comprising a drive motor drivingly connected to a drive wheel and a first forwardly extending lower arm member engageable with the wheelchair when the wheelchair is in the engageable position wherein the first lower arm member is operable between a lowered position in which the first lower arm member is disengaged from the wheelchair and, when the wheelchair is in the engageable position, a raised position in which the first lower arm member engages the wheelchair, the first lower arm member has a first stop member whereby, when the first lower arm member is in the raised position and engages the wheelchair, and when the wheelchair is on a forwardly extending declined surface, the first stop member inhibits forward motion of the wheelchair; and, (b) a grip portion provided on a driving linkage wherein the driving linkage is drivingly connected to the base.

In any embodiment, the apparatus may comprise a sensor operable to send a signal to a user when the wheelchair is in the engageable position.

In any embodiment, the apparatus may comprise a lifting motor that is driving connected to the first lower arm member and a sensor operable to automatically send a signal to the lifting motor when the wheelchair is in the engageable position.

In any embodiment, the apparatus may comprise a securing member inhibiting the first lower arm member moving to the raised position until the wheelchair is in the engageable position.

In any embodiment, the securing member may comprise a lifting motor that is drivingly connected to the first lower arm member and a sensor operable to send a signal to the lifting motor to actuate the lifting motor to raise the first lower arm member to the raised position, wherein the lifting motor is inhibited from operation until the sensor sends a signal to the lifting motor indicative that the wheelchair is in the engageable position.

In any embodiment, the driving linkage may be pivotally mounted to the base.

In any embodiment, the first lower arm member may be moved to the raised position when the driving linkage is pivoted rearwardly.

In any embodiment, the apparatus may comprise at least one steerable wheel.

In any embodiment, the at least one steerable wheel may comprise a pair of rear caster wheels.

In any embodiment, the wheelchair may have first and second laterally spaced apart rearwardly extending anti-tip bars and the first lower arm member may be engageable with the first anti-tip bar and the apparatus may have a second lower arm member that is engageable with the second anti-tip bar.

In any embodiment, the first anti-tip bar may have an anti-tip bar wheel that is secured to the first anti-tip bar by a wheel mount whereby, when the first lower arm member is in the raised position and engages the wheelchair, the first stop member is positioned forward of the wheel mount.

In any embodiment, the first stop member may comprise an upwardly extending flange having a generally U-shaped opening whereby, when the first lower arm member is in the raised position and engages the wheelchair, the first anti-tip bar is located in the generally U-shaped opening and the upwardly extending flange is positioned forward of the wheel mount.

In any embodiment, the apparatus may comprise a first upper arm member having a downwardly extending flange having a generally U-shaped opening whereby, when the first lower arm member is in the raised position, the downwardly extending flange of the first upper arm member is located forward of the upwardly extending flange of the first lower arm member.

In any embodiment, when the first lower arm member is in the raised position and engages the wheelchair, the first anti-tip bar may be located in the generally U-shaped opening of the downwardly extending flange.

In any embodiment, the wheelchair may have a luggage rack and the luggage rack may have a cross member, and the apparatus may comprise an upwardly extending second stop member wherein, when the wheelchair is in the engageable position, the upwardly extending second stop member is positionable forward of the cross member of the luggage rack and at an elevation of the cross member of the luggage rack whereby when the wheelchair is on a forwardly extending declined surface forward motion of the wheelchair is inhibited by engagement between the cross member and the upwardly extending second stop member.

In any embodiment, the upwardly extending second stop member may comprise a vertically translatable rod.

In any embodiment, the upwardly extending second stop member may be positionable forward of the cross member of the luggage rack concurrently with the first lower arm member moving to the raised position.

In any embodiment, the upwardly extending second stop member may be positionable forward of the cross member of the luggage rack subsequent to the first lower arm member moving to the raised position.

In accordance with this broad aspect, there is also provided an apparatus for moving a wheelchair, the wheelchair having a front end, a rear end, first and second laterally opposed sides, and a luggage rack, the luggage rack having a cross member, the wheelchair is positionable in front of the apparatus in an engageable position, the apparatus comprising:

(a) a base comprising a drive motor drivingly connected to a drive wheel, at least one steerable wheel and an upwardly extending stop member wherein, when the wheelchair is in the engageable position, the upwardly extending stop member is positionable forward of the cross member of the luggage rack and at an elevation of the cross member of the luggage rack whereby when the wheelchair is on a forwardly extending declined surface forward motion of the wheelchair is inhibited by engagement between the cross member and the upwardly extending stop member; and, (b) a grip portion provided on a driving linkage wherein the driving linkage is drivingly connected to the base.

In any embodiment, the upwardly extending stop member may comprise a vertically translatable rod.

It will be appreciated by a person skilled in the art that an apparatus or method disclosed herein may embody any one or more of the features contained herein and that the features may be used in any particular combination or sub-combination.

These and other aspects and features of various embodiments will be described in greater detail below.

BRIEF DESCRIPTION OF THE DRAWINGS

For a better understanding of the described embodiments and to show more clearly how they may be carried into effect, reference will now be made, by way of example, to the accompanying drawings in which.

Figure 1A:
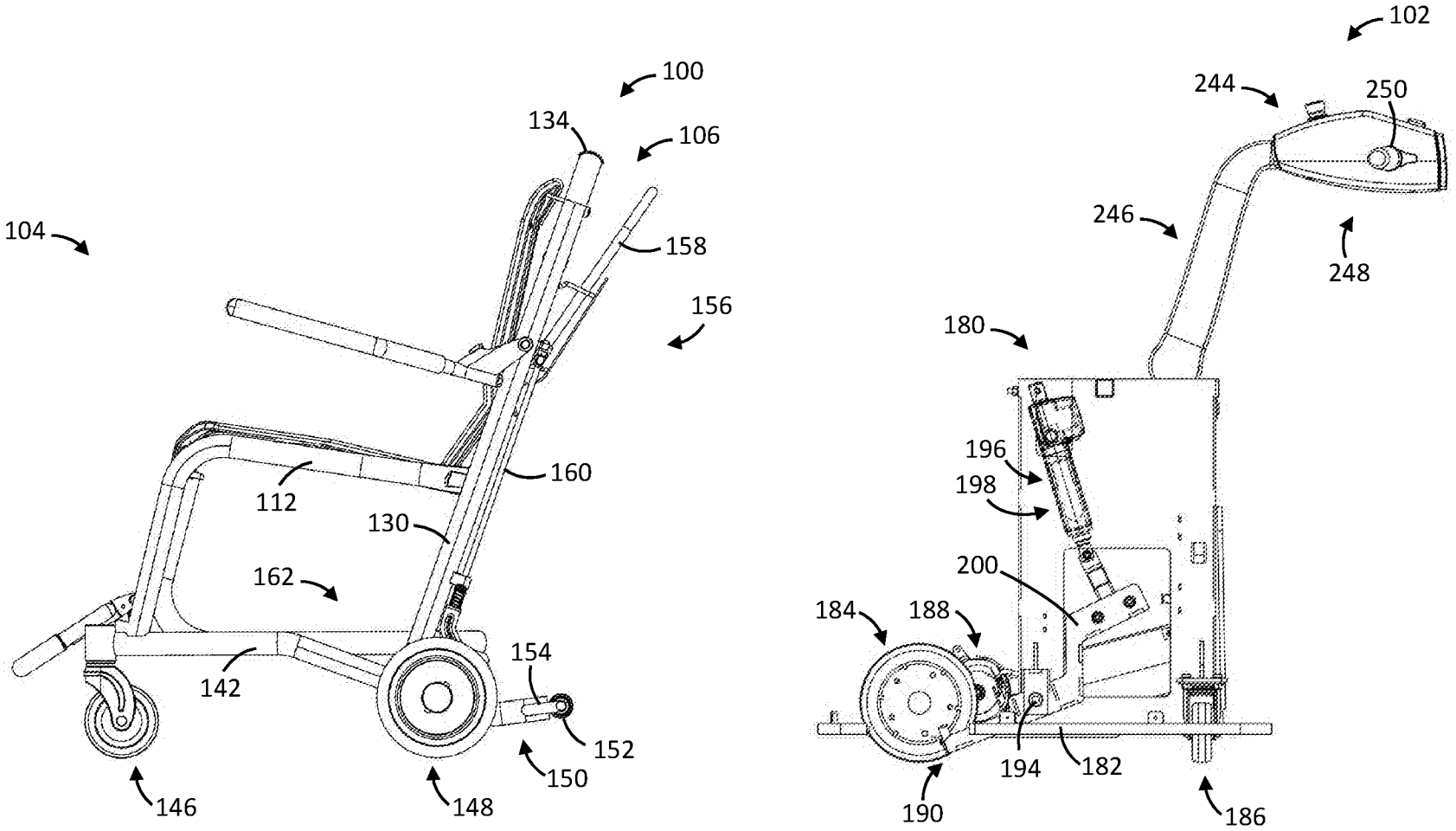
FIG. 1A shows a side view of an apparatus for moving a wheelchair and a wheelchair wherein a portion of the apparatus is shown transparent and wherein the wheelchair is spaced forwardly of the apparatus.

The drawings included herewith are for illustrating various examples of articles, methods, and apparatuses of the teaching of the present specification and are not intended to limit the scope of what is taught in any way.

DESCRIPTION OF EXAMPLE EMBODIMENTS

Various apparatuses and methods are described below to provide an example of an embodiment of each claimed invention. No embodiment described below limits any claimed invention and any claimed invention may cover apparatuses and methods that differ from those described below. The claimed inventions are not limited to apparatuses and methods having all of the features of any one apparatus or method described below or to features common to multiple or all of the apparatuses or methods described below. It is possible that an apparatus or method described below is not an embodiment of any claimed invention. Any invention disclosed in an apparatus or method described below that is not claimed in this document may be the subject matter of another protective instrument, for example, a continuing patent application, and the applicant(s), inventor(s) and/or owner(s) do not intend to abandon, disclaim, or dedicate to the public any such invention by its disclosure in this document.

The terms "an embodiment", "embodiment", "embodiments", "the embodiment", "the embodiments", "one or more embodiments", "some embodiments", and "one embodiment" mean "one or more (but not all) embodiments of the present invention(s)" unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a", "an" and "the" mean "one or more," unless expressly specified otherwise.

As used herein and in the claims, two or more parts are said to be "coupled", "connected", "attached", or "fastened" where the parts are joined or operate together either directly or indirectly (i.e., through one or more intermediate parts), so long as a link occurs. As used herein and in the claims, two or more parts are said to be "directly coupled", "directly connected", "directly attached", or "directly fastened" where the parts are connected in physical contact with each other. As used herein, two or more parts are said to be "rigidly coupled", "rigidly connected", "rigidly attached", or "rigidly fastened" where the parts are coupled so as to move as one while maintaining a constant orientation relative to each other. None of the terms "coupled", "connected", "attached", and "fastened" distinguish the manner in which two or more parts are joined together.

Some elements herein may be identified by a part number, which is composed of a base number followed by an alphabetical or subscript-numerical suffix (e.g. 112*a*, or $\mathbf{112}_1$). Multiple elements herein may be identified by part numbers that share a base number in common and that differ by their suffixes (e.g. $\mathbf{112}_1$, $\mathbf{112}_2$, and $\mathbf{112}_3$). All elements with a common base number may be referred to collectively or generically using the base number without a suffix (e.g. 112).

As described above, the invention relates generally to an apparatus for moving a wheelchair of the type used for moving physically challenged persons about a large facility such as a hospital health care facility, a public space, an airport or the like. Accordingly, the apparatus may be used at venues wherein a person has to travel a distance that is considerable and/or requiring transport of a person at a certain pace, and/or in which movement directions may not be familiar to the challenged person. In general, such apparatuses for moving a wheelchair are intended to be used by a care person to reduce the amount of manual pushing that is required by the care person when transporting a person in a wheelchair from place to place, or from point to point after which the person may be transferred from the chair to some other form of seating, or left with the wheelchair so they may remain seated until a later date.

For example, in an airport, it may be desirable to transport a person in a wheelchair to their gate and allow that person to remain in that wheelchair until the plane is ready for boarding. A detachable apparatus for moving the wheelchair allows a care person to use the apparatus to transport at least a second individual while the first person remains seated. In some examples, a single care person may be able to transport multiple persons in individual wheelchairs to a gate prior to boarding using a single apparatus for moving the wheelchairs and also allow the care person to re-engage and transport each of those persons from the gate, e.g., through a jet way, to the aircraft, when needed during the boarding process. Without such an apparatus for moving a wheelchair, a care person may be required to manually push the wheelchairs, which may lead to fatigue and injury. Further, providing a detachable apparatus for moving a wheelchair as opposed to providing each wheelchair with a drive mechanism may reduce the overhead cost to a facility that provides such a service. For these reasons it is desirable to provide an apparatus for moving a wheelchair that can engage and disengage from a wheelchair, and when engaged, safely transport individuals in their wheelchairs.

Wheelchair Features

The structure and features of various wheelchairs will first be described. The manner of engagement of an apparatus for moving that wheelchair to a particular wheelchair may be dependent on features of that wheelchair. Further, for different embodiments of wheelchairs, features of the apparatus for moving the wheelchair may vary.

Referring first to FIG. 1A, shown therein is an example of a wheelchair 100 and an apparatus 102 for moving the wheelchair 100. It will be appreciated that a wheelchair 100 used with apparatus 102 may be of any size, shape, configuration and construction provided that apparatus 102 is engageable with wheelchair 100 and, optionally, the rear end of wheelchair 100. Several embodiments of wheelchairs that may be used with apparatus 102 are now discussed.

As shown, the wheelchair 100 may have a front end 104, a rear end 106, and first and second laterally opposed sides 108, 110. It will also be appreciated that wheelchair may be collapsible as is known in the art (e.g., the frame may be collapsible such that opposed sides 108, 110 may be brought towards each other), or the frame may be rigid such that the wheelchair is of a fixed configuration.

Wheelchairs typically use a frame to which a material is provided so as to form a seat. As exemplified in FIG. 3C, the first and second laterally opposed sides 108, 110 of the wheelchair 100 each include a generally L-shaped side frame member 112, 114. As shown, the L-shaped side frame members 112, 114 may have generally forwardly and downwardly sloping seat supporting portions 116, 118 and downwardly angled foot portions 120, 122. Suitable seating material is supported between the side frames 112, 114. As exemplified in FIG. 3C, the side frames 112, 114 may have a predetermined spacing 128 between them at the rear end 106 of the wheelchair 100, and a predetermined spacing 124 at the forward end 104 of the wheelchair 100. The width of the rearward portion indicated as 128 may be generally wide enough to provide comfortable seating for a person to sit, and the width 124 of the front portion may provide adequate support for the legs of that person.

In the embodiment of FIG. 1A, the wheelchair moving apparatus 102 is spaced rearward from the wheelchair 100. As exemplified in FIG. 1B, wheelchair moving apparatus 102 has been positioned immediately behind wheelchair 100 in a wheelchair engaging position. It will be appreciated that when wheelchair moving apparatus 102 engages wheelchair 100, wheelchair moving apparatus 102 may be located rearward of wheelchair 100 and may have one or more engagement members that extend forwardly to engage wheelchair 100. Alternately, wheelchair moving apparatus 102 may be partially nested in wheelchair 100. In other words, a portion of wheelchair moving apparatus 102 may be located forward of the rear end of wheelchair 100 when wheelchair moving apparatus 102 engages wheelchair 100. Accordingly, the rear end of wheelchair 100 may have a recess or area in which a forward portion of wheelchair moving apparatus 102 may be received. Accordingly, the width 128 of the rearward portion may be wide enough such that at least a portion of the apparatus 102 for engaging the wheelchair 100 may be nested between the side frames 112, 114.

Alternately, or in addition, the width 128 of the rearward portion 106 of a first wheelchair may be wide enough such that a portion of the front end 104 of a second wheelchair may nest in the rear portion 106 of the first wheelchair. Accordingly, width 124 may be narrower than width 128. Accordingly, front end 104 of a second wheelchair 100 may nest within rear end 106 of a first wheelchair.

As with the seat, wheelchair 100 may have a backrest or seat back frame to which a suitable backrest material is attached. If the wheelchair is collapsible, then the backrest frame is also collapsible. The backrest frame may be of any design. As exemplified in FIG. 1A, to provide a seat back and support, a rearward substantially vertical support frame 126 is provided, having upper back supporting portions 130, 132 and a cross-bar handle 134 extending between the upper ends of the back supporting portions 130, 132. Suitable seat back material is supported by the back supporting portions 130, 132.

Optionally, arm rests 136*a*, 136*b* may be provided. The arm rests 136 may be fixedly mounted in position and orientation on the wheelchair 100 or they may be moveable mounted (e.g., swingably mounted by hinges 138) on, e.g., the back frames 130, 132 so that the arm rests 136 may be swung (pivoted) upwardly out of the way, or may be swung downwardly into the more or less horizontal position as shown for support, where they are held and cannot swing further. A swingable arm rest 136 may greatly facilitate the moving of a person into and out of the wheelchair 100 from the side.

Figure 3A:
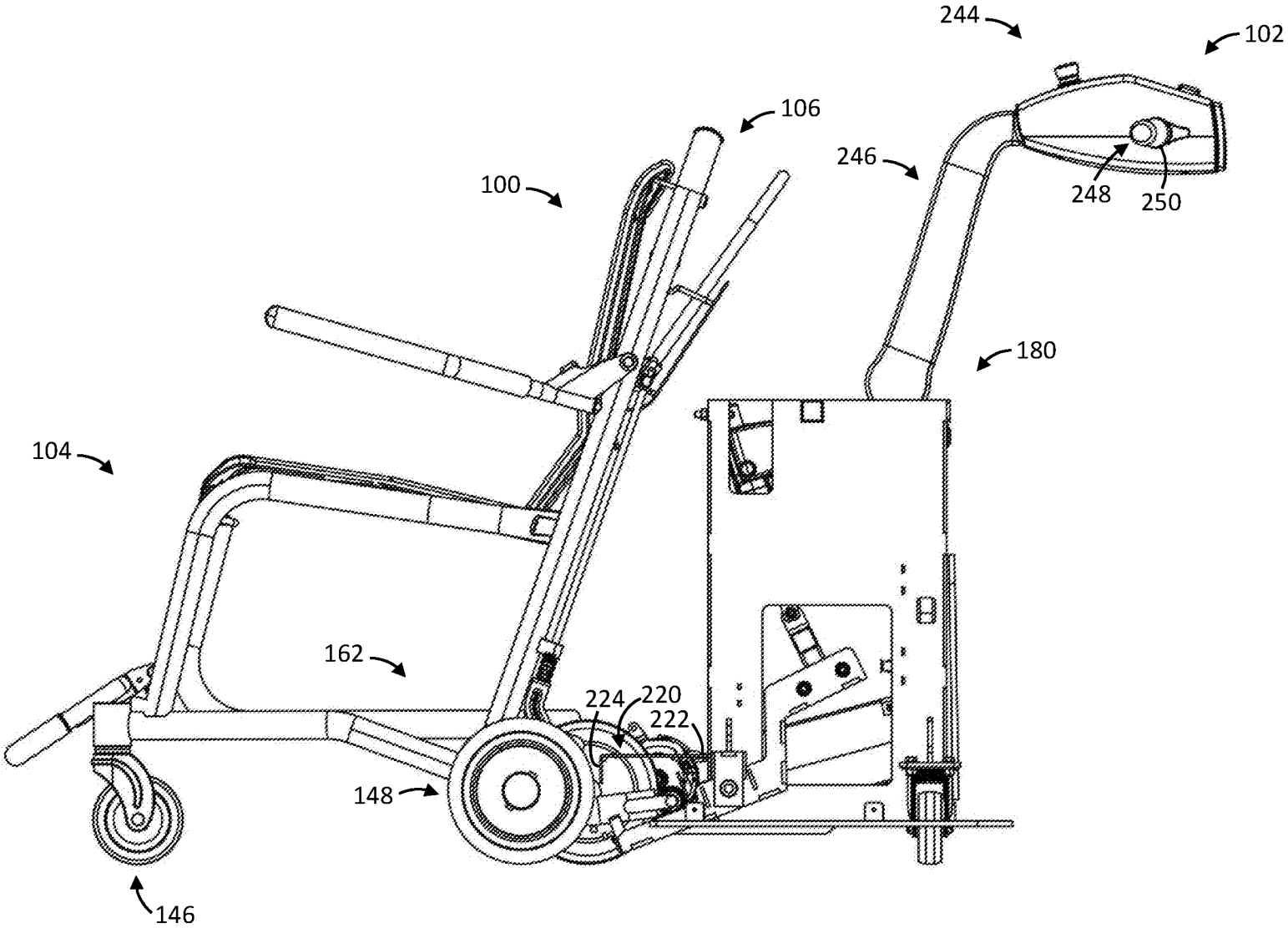
FIG. 3A shows a side view of another apparatus for moving a wheelchair and a wheelchair, wherein the apparatus is in a wheelchair engaging position.
Figure 3B:
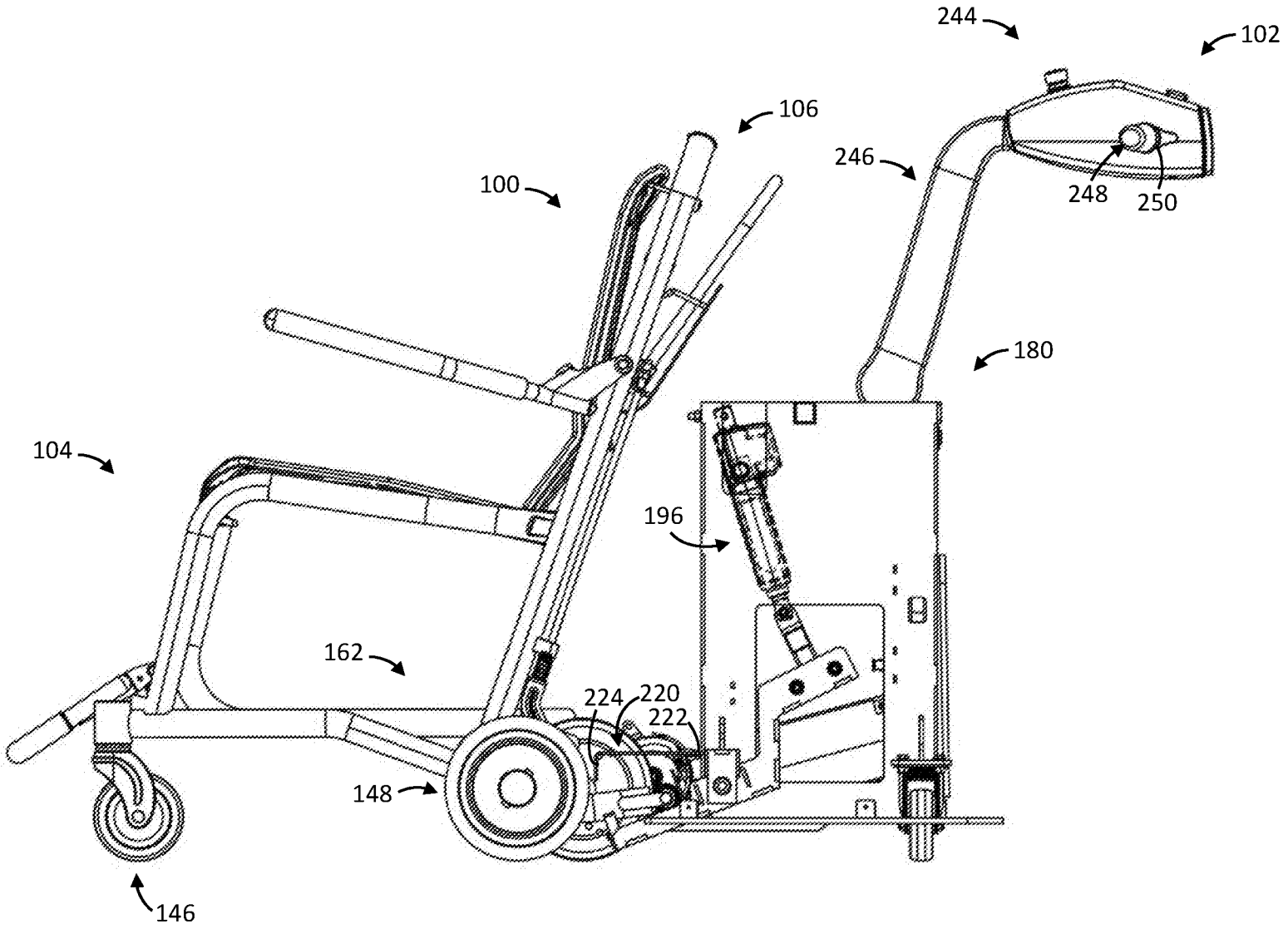
FIG. 3B shows a side view of the apparatus for moving a wheelchair and the wheelchair of FIG. 3A, wherein a portion of the apparatus is shown transparent and wherein the apparatus is in a wheelchair engaging position.
Figure 3C:
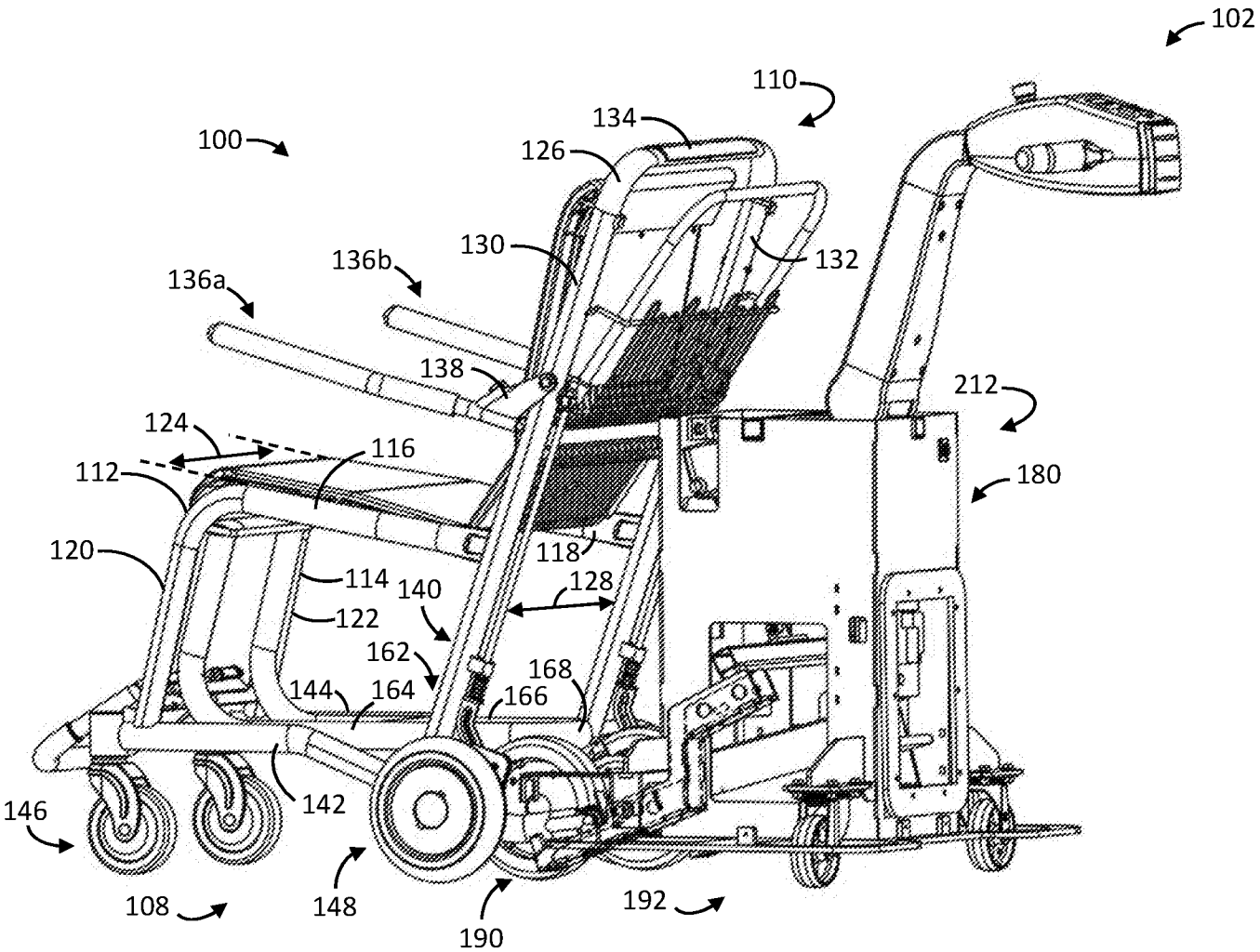
FIG. 3C shows a rear perspective view of the apparatus for moving a wheelchair and the wheelchair of FIG. 3A, wherein the apparatus is in a wheelchair engaging position.

Optionally, as exemplified in FIG. 3C, the rear frames 130, 132 extended downwardly as at 140, to provide rearward support. A pair of lower bracing frames 142, 144 may extend from the lower ends of forward frames 120, 122 to the lower ends of the lower portions of the rear frames 130, 132.

Wheelchair 100 may have any wheels known in the wheelchair art, and they may be located and mounted by any means known in the art. In some examples of the wheelchair 100, front wheels 146 may have a caster action and may be provided at the forward ends of the bracing frames 142, 144. Rear wheels 148 may be provided just rearwardly of the junction between the lower portions of the rear frames 130, 132 and the bracing frames 142, 144. Optionally, as exemplified, the two rear wheels 148 may be separately journalled on individual axles (not shown) so that there is a clear space between the two rearward portions of the bracing frames 142, 144 so as to enable nesting of a second wheelchair 100 or apparatus 102. Accordingly, as exemplified in FIG. 3C, the space between the two rear wheels 148 may allow for the apparatus 102 to be positioned at least partially beneath the wheelchair 100, between the rear wheels 148, to facilitate engagement of the wheelchair 100 and the apparatus 102.

As shown in FIG. 1A, the wheelchair 100 may include at least one anti-tip bar 150 having an optional anti-tip bar wheel 152. In the example illustrated, the anti-tip bar wheel 152 is attached to the anti-tip bar 150 by a wheel mount 154. The anti-tip bar wheel 152 may enable a care person, when manually pushing the wheelchair 100, to tip the chair slightly backwards so as to raise the front wheels 146 over a small obstruction, if it is necessary, without danger of the wheelchair 100 over tipping backwards.

In some examples of the wheelchair 100, to provide stability and security for the chair, braking means 156 may be provided, optionally to the back wheels 148. In the example illustrated, when the care person wishes to move the wheelchair 100, he or she may grasp a brake lever 158 and push it, e.g., forward against the cross-bar handle 134. The brake lever 158 may be connected to brake pads or brake bars by cables or hydraulic hosing 160. In the example illustrated, by pushing the brake lever 158 forward, the brakes will disengage, thereby releasing the rear wheels 148 for rolling. Optionally, a spring or other biasing device (not shown) may bias the brakes into an engaged position so that the brakes are normally "on". That is, in some examples, releasing the brake lever 158 will cause the brakes to be automatically applied.

Referring back to FIG. 3C, the wheelchair 100 may be provided with a luggage rack 162, which may be of any construction and size. In the example illustrated, the luggage rack 162 includes laterally opposed bracing members 164, 166 connected to the frame member 112, 114 and lower bracing member 142, 144 of the wheelchair 100. As shown, the luggage rack 162 may also include a cross member 168 extending between the bracing members 164, 166. In some examples, at least a portion of the cross member 168 may extend transverse to the forward direction of the wheelchair 100.

Referring back to FIG. 1A, in the example illustrated, the luggage rack 162 extends rearwardly beyond a portion the back frames 130, 132 of wheelchair 100. As shown, in some examples of the wheelchair 100, the luggage rack 162 may not extend rearwardly beyond the anti-tip bar wheel 152.

Apparatus for Moving a Wheelchair

Wheelchair moving apparatus 102 may be of various configurations. Wheelchair moving apparatus 102 has a wheelchair engaging mechanism that is engageable with a wheelchair 100, wheels or other ground engaging members to move across the ground (hereinafter referred to generically as "wheels") and a drive handle 244 that is used by a care person to steer (if the apparatus includes a driving motor 188) or to steer and push (if a driving motor 188 is not provided).

As exemplified in FIG. 1A, the wheelchair moving apparatus 102 may include a base 180 having a frame 182 supported by a pair a front wheels 184 and a pair of rear wheels 186. Base 180 may be of any particular shape. As shown, the base 180 may include a drive motor 188 connected to at least one of the wheels 184, 186. In the example illustrated, the drive motor 188 is connected to the front wheels 184.

The front and/or rear wheels 184, 186 may be steerable (e.g., the front and/or rear wheels 184, 186 may be caster wheels). As exemplified in FIG. 1A, apparatus 102 includes at least one steerable wheel. Optionally, as shown, the at least one steerable wheel may be a pair of rear caster wheels 186.

Base 180 is also provided with a wheelchair engaging mechanism. The wheelchair engaging mechanism is operable to engage the wheelchair and inhibit forward motion of a wheelchair from apparatus 102 when wheelchair 100 and apparatus 102 are on a decline. Accordingly, the wheelchair engaging mechanism is operable between a wheelchair engaging position (as exemplified in FIG. 1B) in which the apparatus 102 has not engaged a wheelchair 100, and an engaged position (as exemplified in FIG. 1D) in which apparatus 102 has engaged the wheelchair 100 and a stop member 206 is positioned to inhibit forward motion of a wheelchair from apparatus 102 when wheelchair 100 and apparatus 102 are on a decline.

If wheelchair 100 has a brake, then apparatus 102 may be configured to disengage the brake and/or to raise the wheels on which the brake acts so that wheelchair 100 may be moved by apparatus 102. As exemplified and discussed previously, the rear wheels 148 of wheelchair 100 may be locked by a brake 156 which is biased to the on position. In such a case, apparatus 102 may lift the rear wheels 148 off the ground, e.g. when the wheelchair 100 is engaged by apparatus 102. Optionally, as discussed herein, apparatus 102 may lift the rear wheels off the ground and position a stop member 206 to inhibit forward motion of wheelchair 100 with respect to apparatus 102 when the wheelchair 100 is engaged by apparatus 102. To that end, apparatus 102 may have a lifting motor 196 and one or more lifting arm members 190.

As exemplified in FIG. 1A, the drive handle 244 comprises a grip portion 248. The grip portion 248 may be of any configuration that permits a care person to grasp and operate the apparatus 102. As exemplified, grip portion 248 may include a left hand grip 250 and a right hand grip (not shown).

Drive handle 244 may be drivingly connected to the base 180 by a driving linkage 246. Driving linkage 246 may be a rigid shaft that extends between the base 180 and the drive handle 244. If a drive motor 188 is provided, then driving linkage 246 may have a hollow interior through which wires that extend between one or more controls on the drive handle 244 and driving motor 188 may pass. If a drive motor 188 is not provided, then driving linkage 246 may be moveably steeringly mounted to base 180.

Drive handle 244 and driving linkage 246 may be used by an operator of the apparatus 102 to signal the driving motor 188 and/or the lifting motor 196 to operate. For example, drive handle 244 may have one or more actuators (e.g., a rocker switch) which may be moved by a user to actuate driving motor 188 and/or the lifting motor 196. Alternately, or in addition, driving motor 188 and/or the lifting motor 196 may be actuated by motion of the grip portion 248 and/or driving linkage 246.

As exemplified, the driving linkage 246 may be pivotally mounted to the base 180. When pivotally mounted to the base 180, upward and downward pivoting of the driving linkage 246 may correspond with a signal to one of the driving motor 188 and the lifting motor 196. For example, in some embodiments, when the driving linkage 246 is pivoted downwardly, a signal may be sent to the lifting motor 196 to move the first lifting arm member 190 from a lowered disengaged position to a raised engaged position. In another example, when the driving linkage 246 is pivoted upwardly, a signal may be sent to the driving motor 188 to drive the apparatus 102 forward and when the driving linkage 246 is pivoted downwardly, a signal may be sent to the driving motor 188 to drive the apparatus 102 backward.

In some examples, the driving linkage 246 may include a dead man's switch (not shown). For example, grip portion 248 may have sensors therein to register that an operator's hands are on the grip portion 248. When in use, that sensor may send a signal to the driving motor 188 to stop if the sensor registers that the operators hand(s) are removed from the grip portion 248.

In some examples, the apparatus 102 may be autonomous, and therefore may not include a drive handle. In this example, the apparatus may include a plurality of sensors and a computer to control movement of the apparatus 102. Any required controls may be located, for example, on the base 180 of the apparatus 102.

As exemplified in FIG. 1A, the wheelchair engaging mechanism may comprise a first forwardly extending lower arm member 190. Lower arm member 190 may be configured and sized such that when apparatus 102 is positioned in a wheelchair engaging position, lower arm member 190 is moveable between a disengaged position and an engaged position. In the disengaged position, apparatus 102 is moveable to the wheelchair engaging position and is also moveable rearwardly away from the wheelchair engaging position. In the engaged position, apparatus 102 is drivingly connected to wheelchair 100.

Figure 1B:
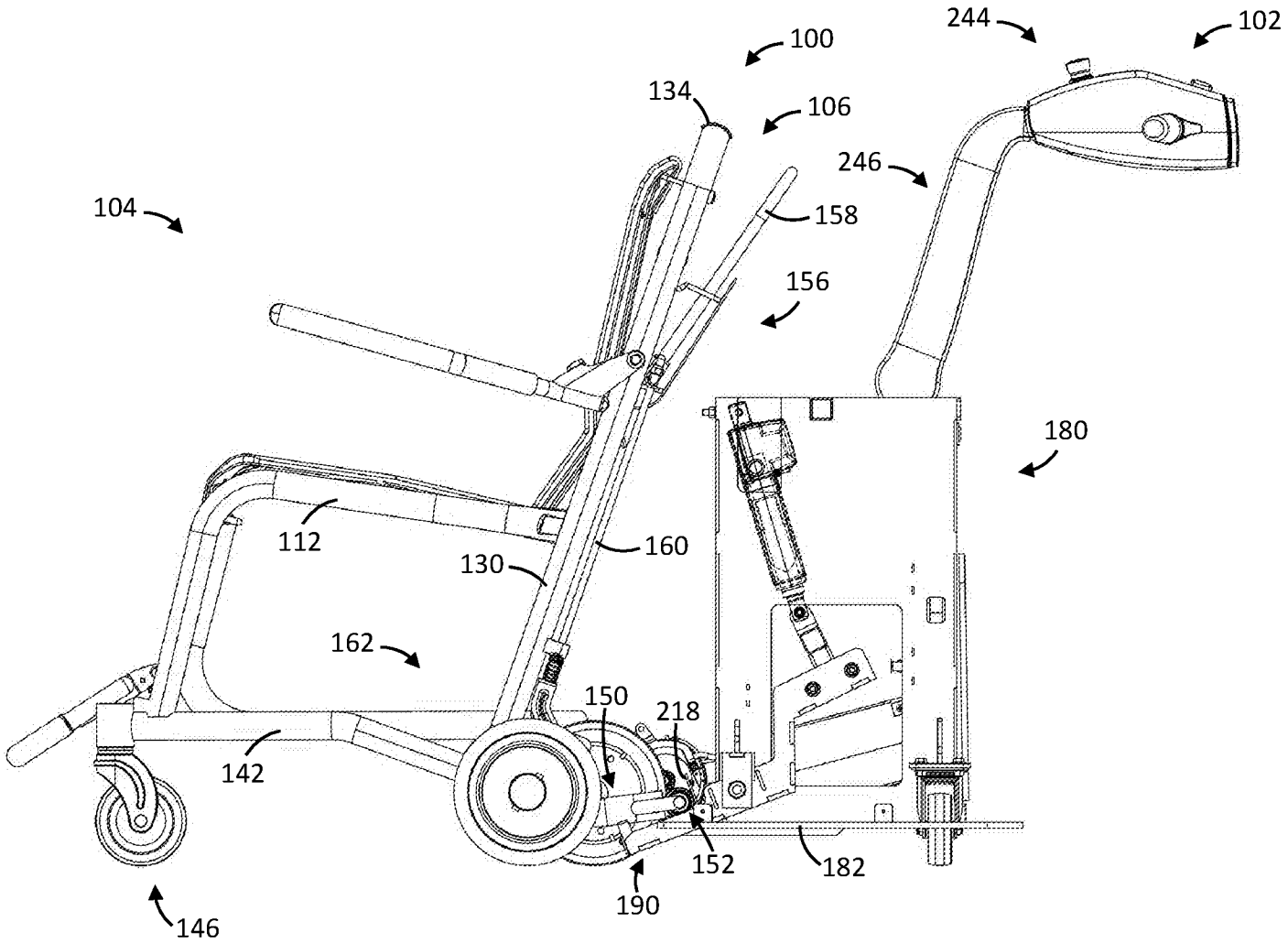
FIG. 1B shows a side view of the apparatus for moving a wheelchair and the wheelchair of FIG. 1A, wherein the apparatus is positioned adjacent a rear of the wheelchair so as to be ready to engage the wheelchair (a wheelchair engaging position)

For the lower arm member 190 to engage the wheelchair 100, the wheelchair 100 must be in an engageable position relative to the apparatus 102, as is shown in FIG. 1B. When in the engageable position, the first lower arm member 190 may be moved from a lowered, i.e. disengaged, position (see, FIG. 1B) to a raised, i.e. engaged, position (see, FIG. 1C). That is, in the example illustrated, with the first lower arm member 190 in the lowered position, the apparatus 102 may be moved from a non-engageable position, shown in FIG. 1A, to the engageable position (the wheelchair engaging position), shown in FIG. 1B. In the engageable position, the first lower arm member 190 may be below a surface of the wheelchair 100 which lower arm member 190 engages when it is raised. When in the engageable position, the first lower arm member 190 may be moved to the raised position, shown in FIG. 1C, in which the first lower arm member 190 engages an engagement surface of the wheelchair 100, thereby connecting the wheelchair 100 to the apparatus 102.

The engagement surface on the wheelchair 100 may be any surface which the first lower arm member 190 may engage. In some examples, the engagement surface may be a portion of one of the frame members 112, 114, the lower brace frame members 142, 144, or the rear frame members 130, 132. In another example, the engagement surface may be a portion of the luggage rack 162. In yet another example, the engagement surface may be a rearwardly extending bar connected to one of the side frame members 112, 114, the lower brace frame members 142, 144, the rear frame member 130, 132 or the luggage rack 162. In the example illustrated, the engagement surface is an anti-tip bar 150.

Since the location of the engagement surface may vary between different embodiments of wheelchairs, the position of the first lower arm member 190 on the base 180 may also vary, accordingly. For example, in some embodiments, the first forwardly extending lower arm member 190 may be positioned transverse of a centrally positioned forward/rearward axis of the apparatus 102, i.e. laterally off center. Accordingly, as exemplified in FIG. 3C, the first forwardly extending lower arm member 190 may be positioned proximate a first lateral side 192 of the base 180.

Figure 1C:
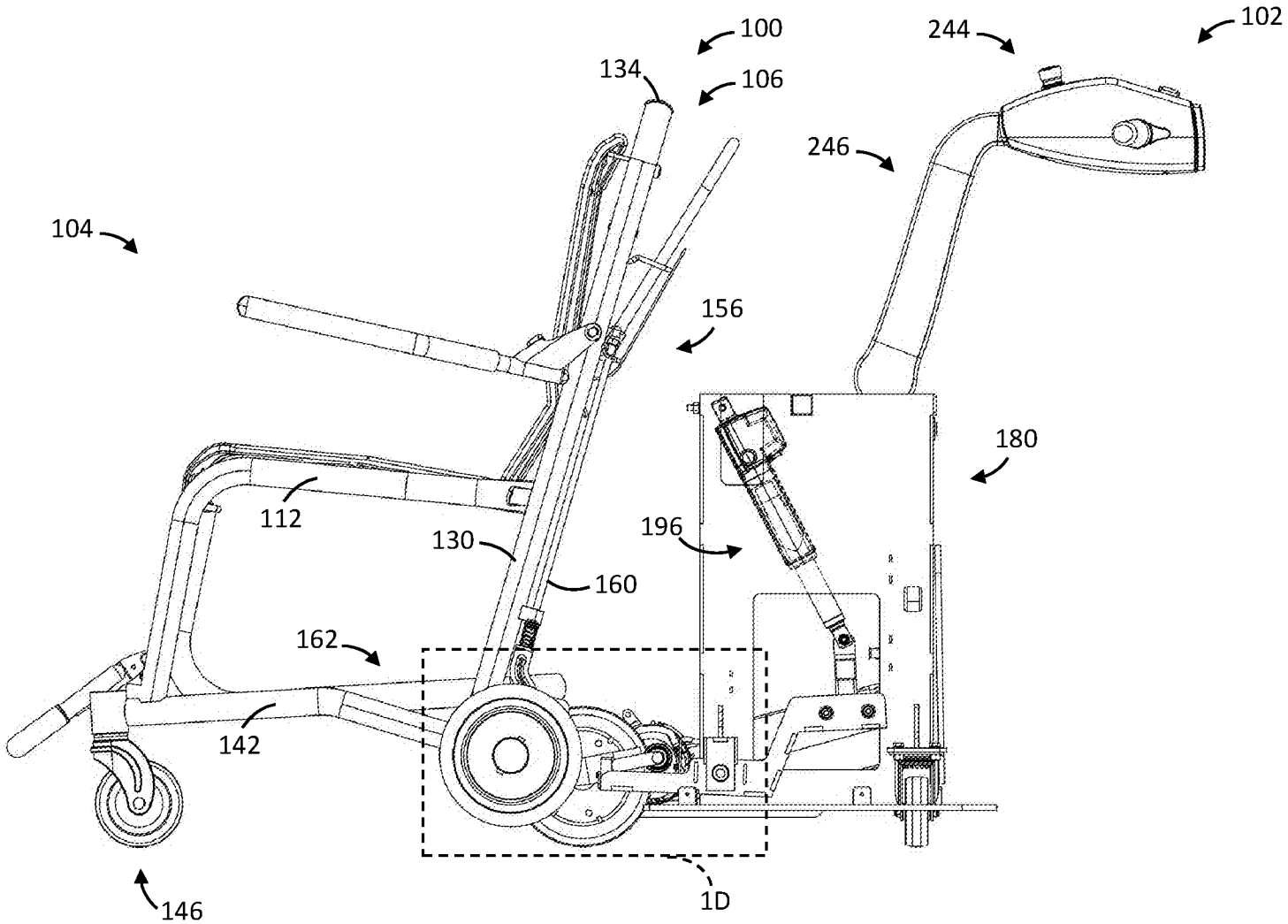
FIG. 1C shows a side view of the apparatus for moving a wheelchair and the wheelchair of FIG. 1A, wherein the wheelchair is engaged by the apparatus.

Lower arm member 190 may be rotatably mounted or translatable between the lowered position (as shown in FIG. 1B) and the raised position (as shown in FIG. 1C). As exemplified in FIG. 1A, the first lower arm member 190 is pivotally connected to the frame 182, such as at a pivot connection 194. In other examples, the first lower arm member 190 may be connected to the frame 182 by a pin in a horizontal slot (not shown). In this example, the entire first lower arm member 190 may translate vertically relative to the frame 182 when moving from the lowered position to the raised position.

Optionally a lifting motor 196 is provided. When provided, lifting motor 196 may be drivingly connected to the first lower arm member 190 to move the first lower arm member 190 between the lowered and raised positions. In the example illustrated, the first lower arm member 190 is moved between the lowered and raised positions by a hydraulic actuating cylinder 198. Specifically, as shown, the hydraulic cylinder 198 may push and pull on a portion 200 of the first lower arm member 190 that extends rearward of the pivot connection 194. In the example illustrated, when the hydraulic cylinder 198 extends, i.e. pushes on the rearward portion 200 of the first lower arm member 190, the first lower arm member 190 moves to the raised position. When the hydraulic cylinder 198 retracts, i.e., pulls on the rearward portion 200 of the first lower arm member 190, the first lower arm member 190 moves to the lowered position.

A stop member 202 may be provided on lower arm member 190. Stop member 202 may be any member that, when lower arm member 190 is in the raised position, is positioned to inhibit, and optionally prevent, the first lower arm member 190 from becoming disengaged from the wheelchair 100 in which case the wheelchair 100 could roll down a declined surface and become detached from the apparatus 102. As exemplified in FIG. 1D, the first lower arm member 190 may have a first stop member 202 that may inhibit forward motion of the wheelchair 100 when the first lower arm 190 is in the raised position and engaged to the wheelchair 100.

For the stop member 202 to inhibit forward motion of the wheelchair 100, the wheelchair 100 may include an engagement surface which may contact the stop member 202. The engagement surface may be any portion of wheelchair 100 and stop member 202 may be of any shape that will engage the engagement surface. The engagement or abutment surface of the wheelchair 100 may be a groove into which the stop member 202 of the apparatus 102 may slide into (not shown). In yet another example, the first lower arm member 190 may have a first stop member 202 in the form of a pin and the engagement surface may be a hole to receive the pin (not shown). As exemplified in FIG. 1D, the abutment surface on the wheelchair is the wheel mount 154 for securing the first anti-tip bar wheel 152 to the anti-tip bar 150.

Figure 1D:
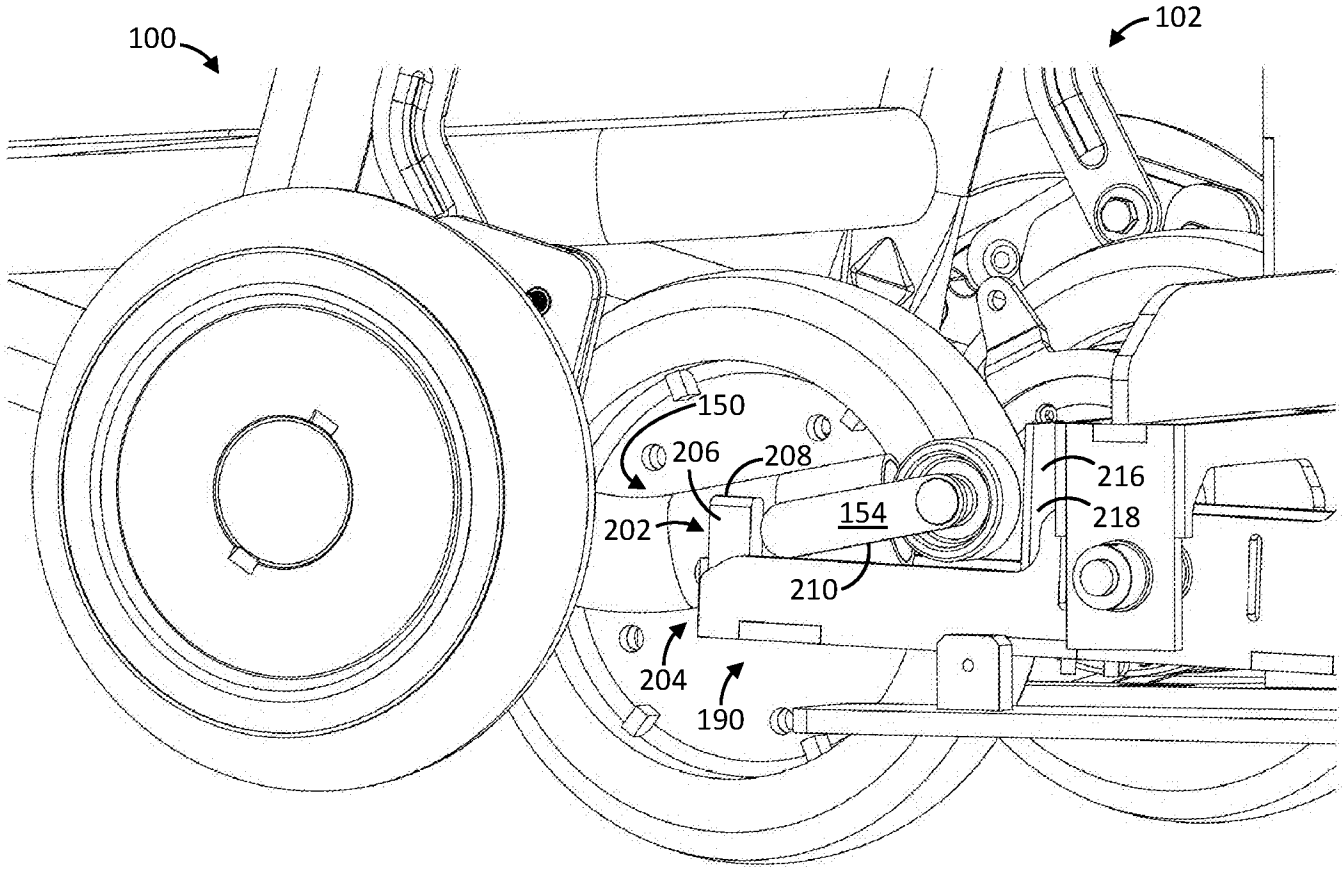
FIG. 1D shows an enlarged perspective view of section 1D of FIG. 1C.

As exemplified in FIG. 1D, the first stop member 202 may extend upwardly from the first lower arm member 190. As shown, the first stop member 202 may extend from a forward distal region 204 of the first lower arm member 190. In some examples of the apparatus 102, the first stop member 202 may be an upwardly extending flange 206 having a generally U-shaped opening. In this example, when the first lower arm member 190 is in the raised position and engaged to the wheelchair 100, the first anti-tip bar 150 may be located in the generally U-shaped opening.

As shown in FIG. 1D, when the apparatus 102 and the wheelchair 100 are engaged, the stop member 202 and the abutment surface are axially aligned (i.e., stop member is at the same elevation as and forward of the abutment surface). This alignment may restrict the abutment surface from axially (i.e. forwardly) moving past stop member 202, thereby restricting forward motion of the wheelchair 100 relative to the apparatus 102, thereby keeping the wheelchair 100 engaged to the apparatus 102 (at least in the forward direction).

In the example illustrated, because the stop member 202 is positioned at the elevation of and directly forward of wheel mount 154 when in the engageable position, the first lower arm member 190 must be moveable such that an upper edge 208 of the stop member 202 is lower than a bottom edge 210 of the wheel mount 154 when the first lower arm member 190 is the in lowered position so as to allow the wheelchair to be moved forwardly from apparatus 102. In the example illustrated, if the upper edge 208 of the stop member 202 were not positionable lower than the bottom edge 210 of the wheel mount 154, the stop member 202 and the wheel mount 154 would inhibit apparatus 102 from being positioned in the wheelchair engaging position.

In some embodiments of the apparatus, the stop member 202 may be moveable (e.g., rotatable) relative to the first lower arm member 190 from a first position substantially in-line with the transverse axis of the apparatus 102 to the position shown in FIG. 1D (e.g., it may be rotatably forwardly as lower arm 190 is moved to the lowered position). Alternately, it may be retractable (e.g., it may be a telescoping member). This may reduce the extent the first lower arm member 190 must be lowered to allow for the apparatus 102 and the wheelchair 100 to be positioned in the engageable position.

Referring to FIG. 1C, in the example illustrated, when the wheelchair 100 is engaged to the apparatus 102, i.e. when the first lower arm member 190 is in the raised position, the rear wheels 148 of the wheelchair 100 may be lifted off a ground surface. It may be desirable to lift the rear wheels 148 off the ground surface because, as described previously, in some examples of the wheelchair 100, the wheelchair 100 is provided with a braking mechanism 156 that is automatically applied to the rear wheels. Lifting the rear wheels 148 of the wheelchair 100 off of the ground surface when engaged to the apparatus 102 may allow for the wheelchair 100 to have an automatic braking system 156 as described previously, and may not require the operator of the apparatus 102 to grasp the brake lever 158 to disengage the brakes when moving the apparatus 102 and the engaged wheelchair 100.

To lift the rear wheels 148 of the wheelchair 100 off the ground surface, it may be advantageous to provide a second forwardly extending lower arm member (not shown). Therefore, a lower arm member 190 may be provided on each lateral side of apparatus 102 and each may be positioned, e.g., to engage an anti-tip bar of wheelchair 100. By providing first and second lower arm members that are laterally spaced apart, the wheelchair 100 may be more stable when its rear wheels 148 are lifted off the ground surface. That is, in an embodiment of the apparatus 102 that includes only a first lower arm member 190, the first lower arm member 190 may act as a lateral fulcrum for at the rear end 106 of the wheelchair 100.

In the example illustrated, the apparatus 102 for moving the wheelchair 100 includes a second forwardly extending lower arm member. Although not visible in the drawings, the second lower arm member is similar to the first lower arm member 190, except it is positioned proximate the second lateral side 212 of the base 180. Accordingly, any of the examples discussed above with reference to the first lower arm member 190 may be applied to the second lower arm member. Moreover, any of the examples discussed below with reference to the first lower arm member 190 may be applied to the second lower arm member. Further, the discussion below is not meant to be limited to apparatuses 102 having a single lower arm member.

Figure 3D:
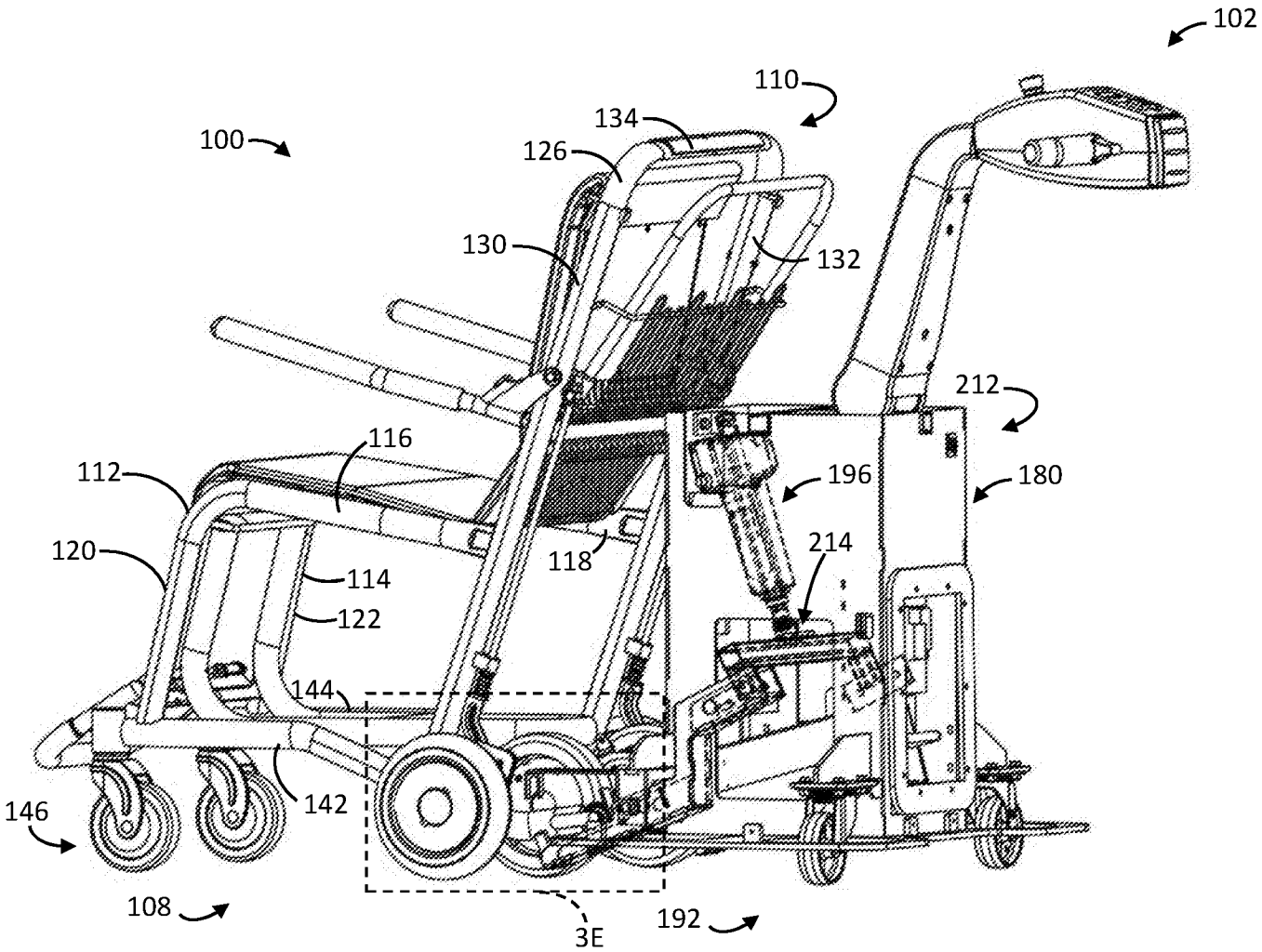
FIG. 3D shows a perspective view of the apparatus for moving a wheelchair and the wheelchair of FIG. 3C, wherein a portion of the apparatus is shown transparent.
Figure 3E:
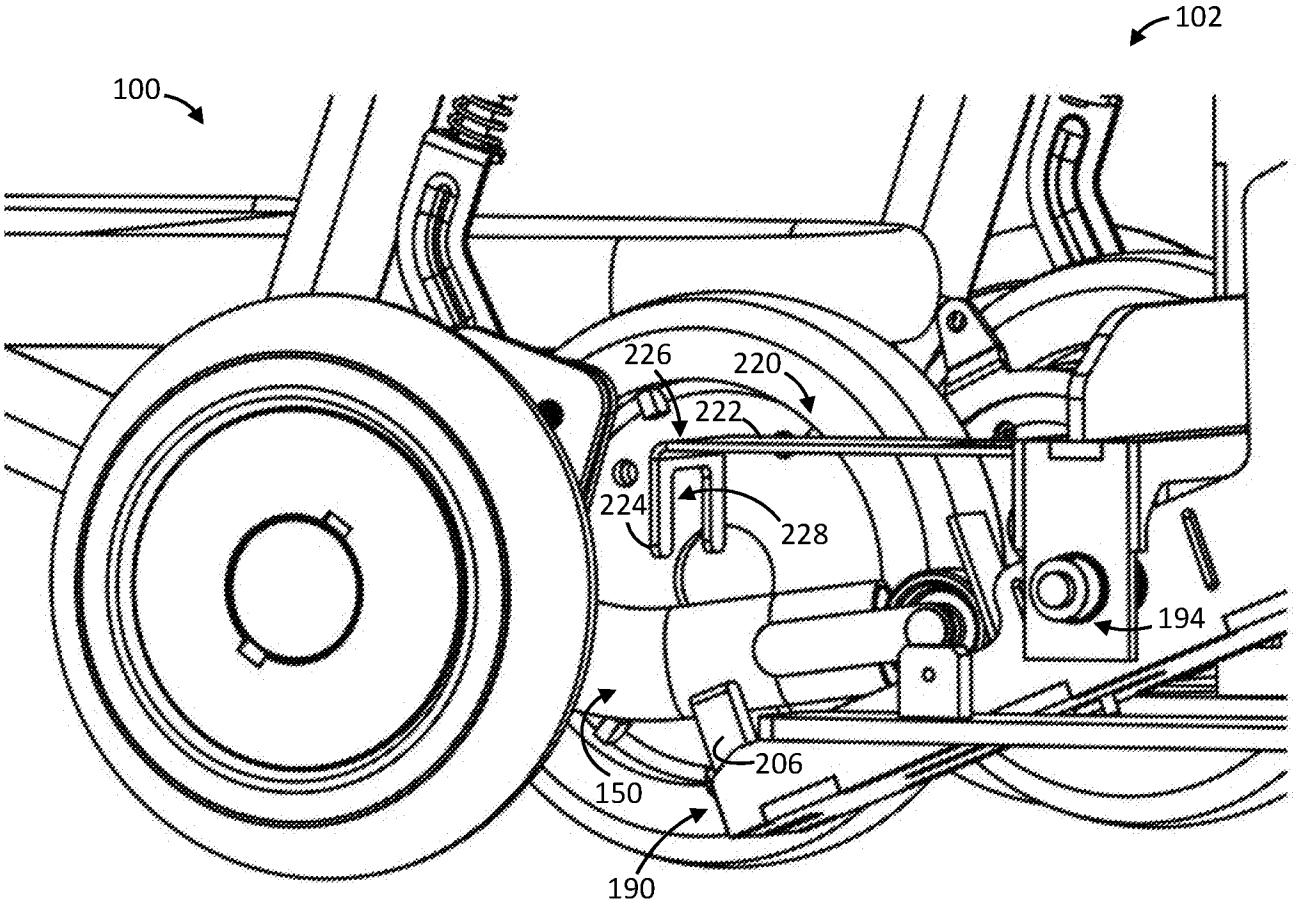
FIG. 3E shows an enlarged perspective view of section 3E of FIG. 3D.
Figure 3F:
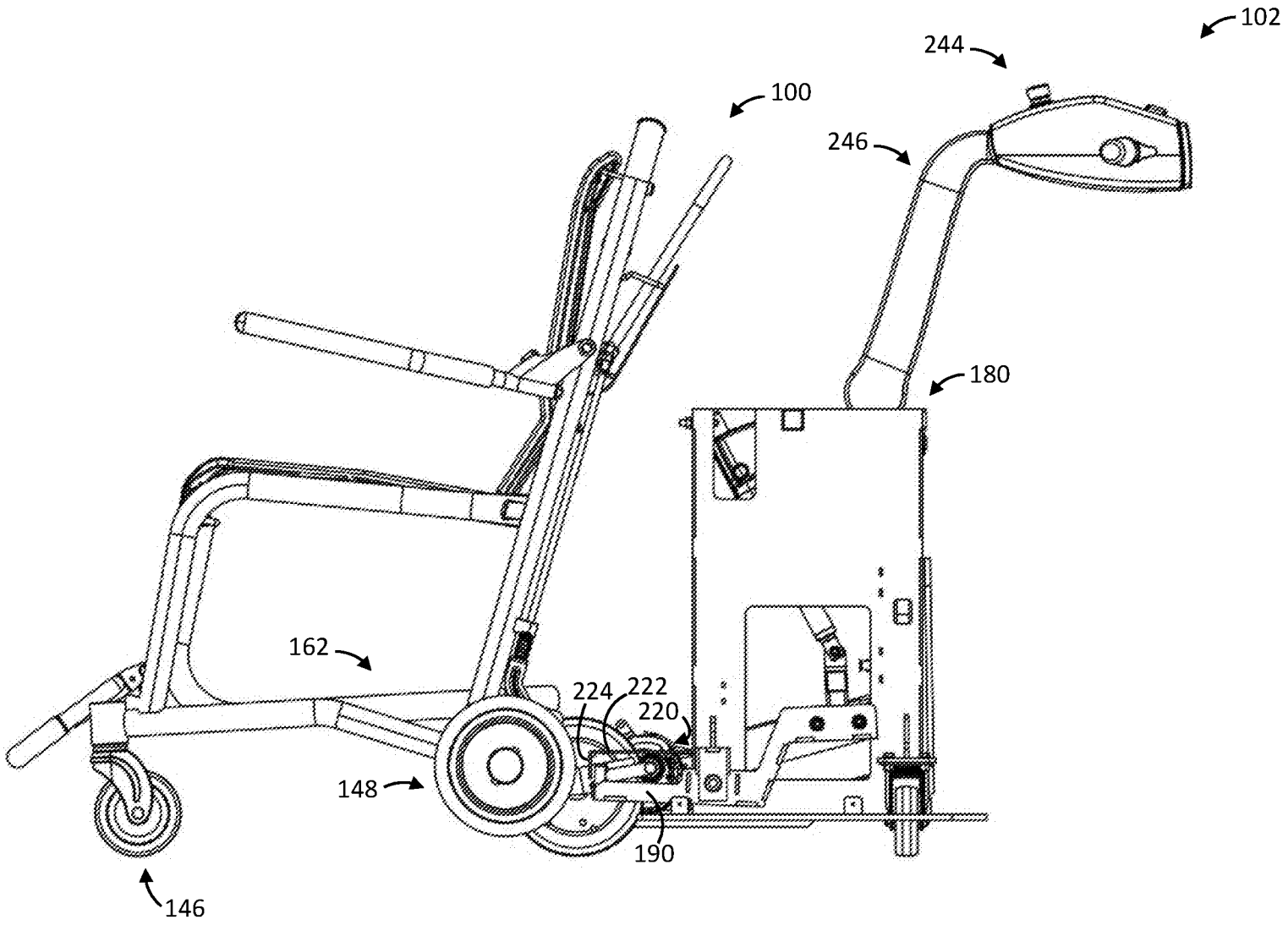
FIG. 3F shows a side view of the apparatus for moving a wheelchair and the wheelchair of FIG. 3A, wherein the wheelchair is shown engaged by the apparatus.
Figure 3G:
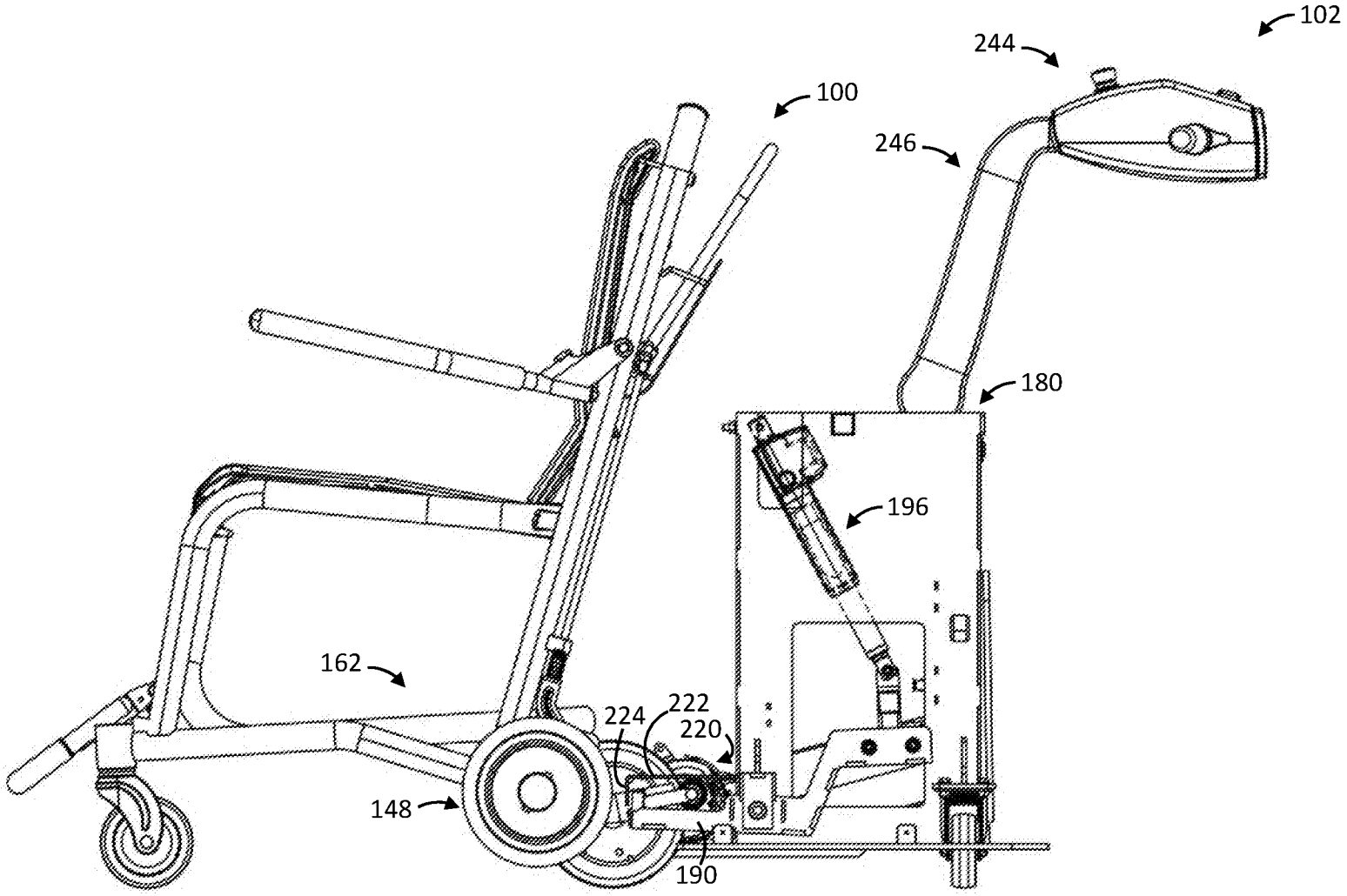
FIG. 3G shows a side view of the apparatus for moving a wheelchair and the wheelchair of FIG. 3F, wherein a portion of the apparatus is shown transparent and wherein the wheelchair is shown engaged by the apparatus.
Figure 3H:
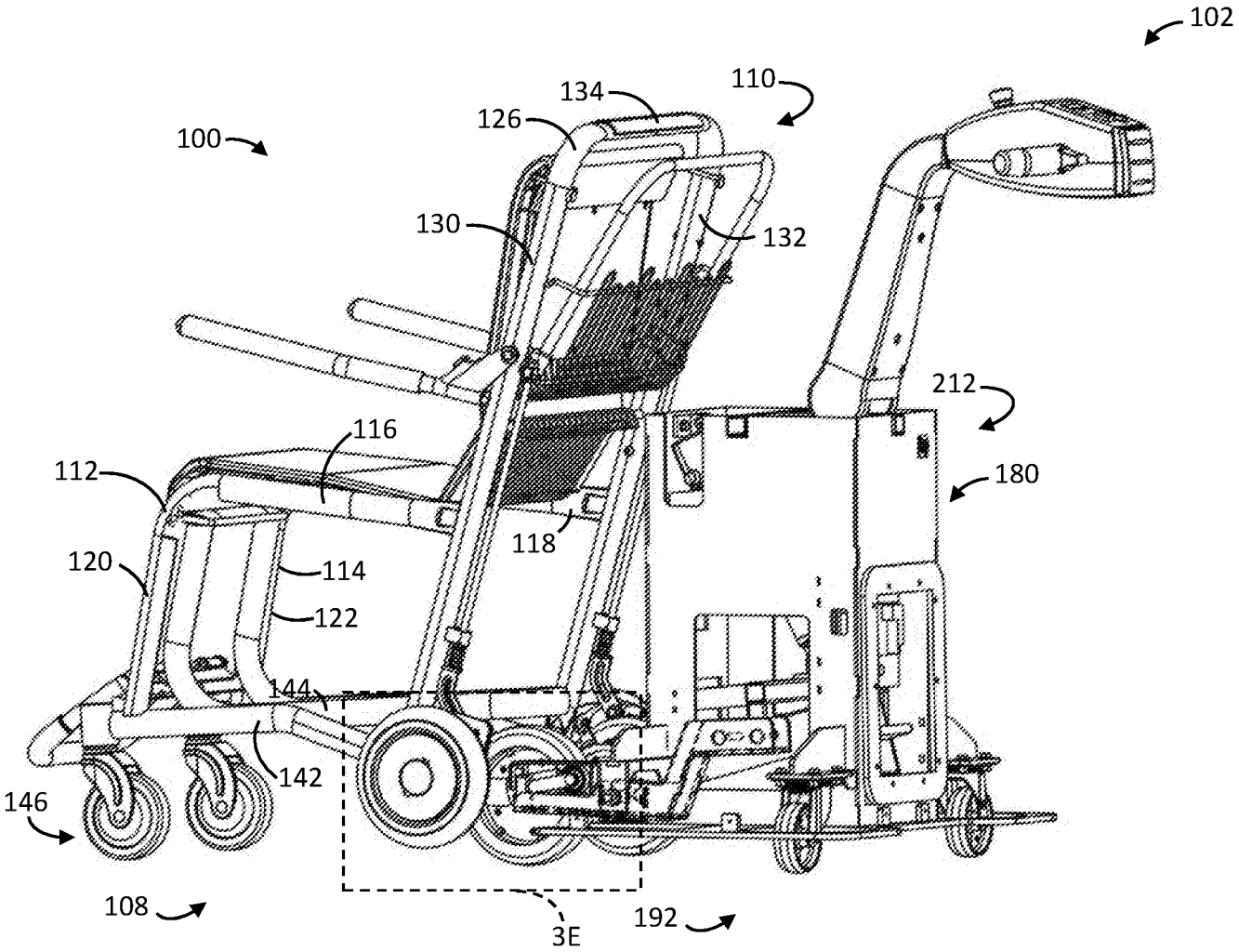
FIG. 3H shows a rear perspective view of the apparatus for moving a wheelchair and the wheelchair of FIG. 3F.
Figure 3I:
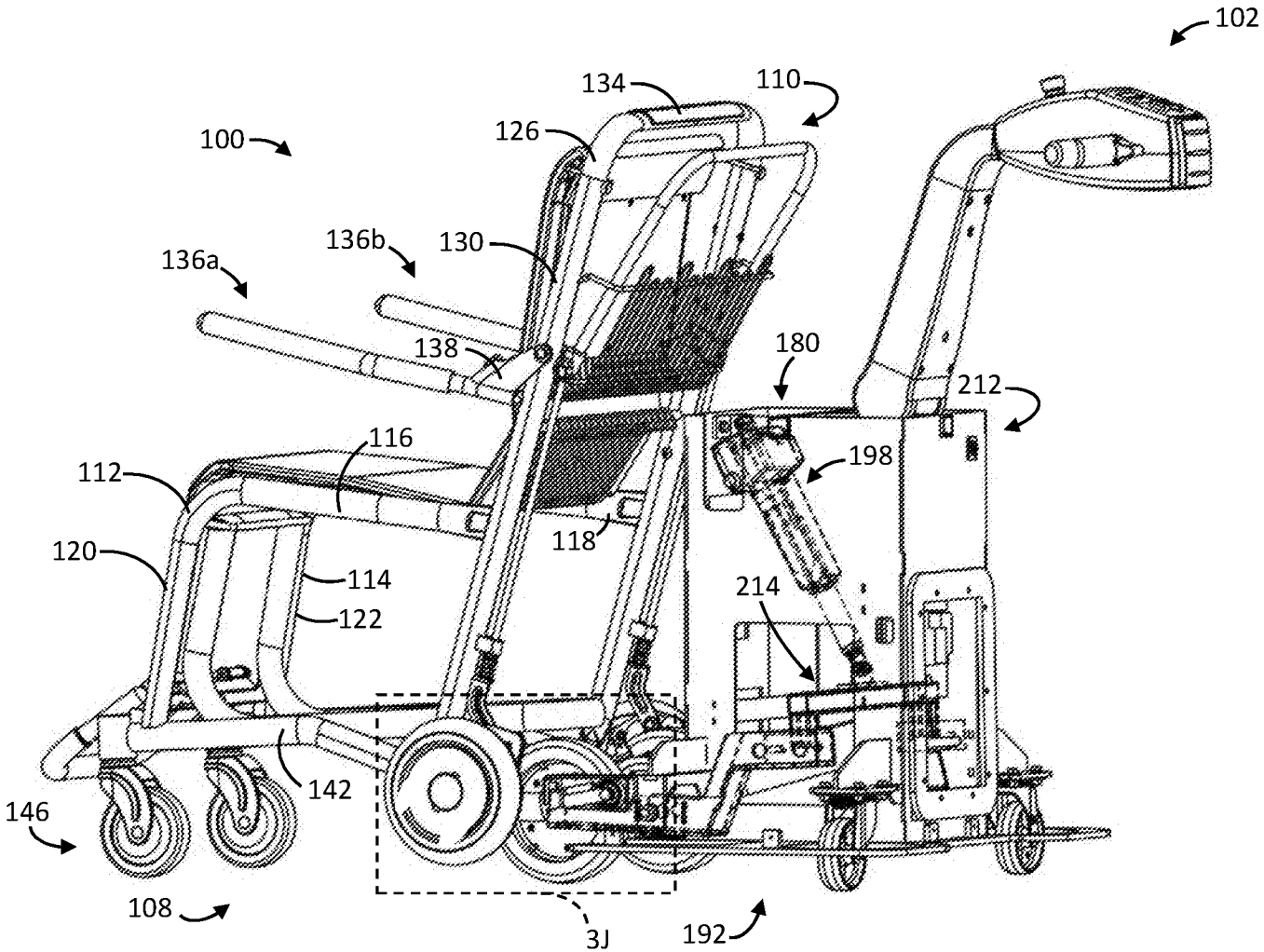
FIG. 3I shows a rear perspective view of the apparatus for moving a wheelchair and the wheelchair of FIG. 3H, wherein a portion of the apparatus is shown transparent.
Figure 3J:
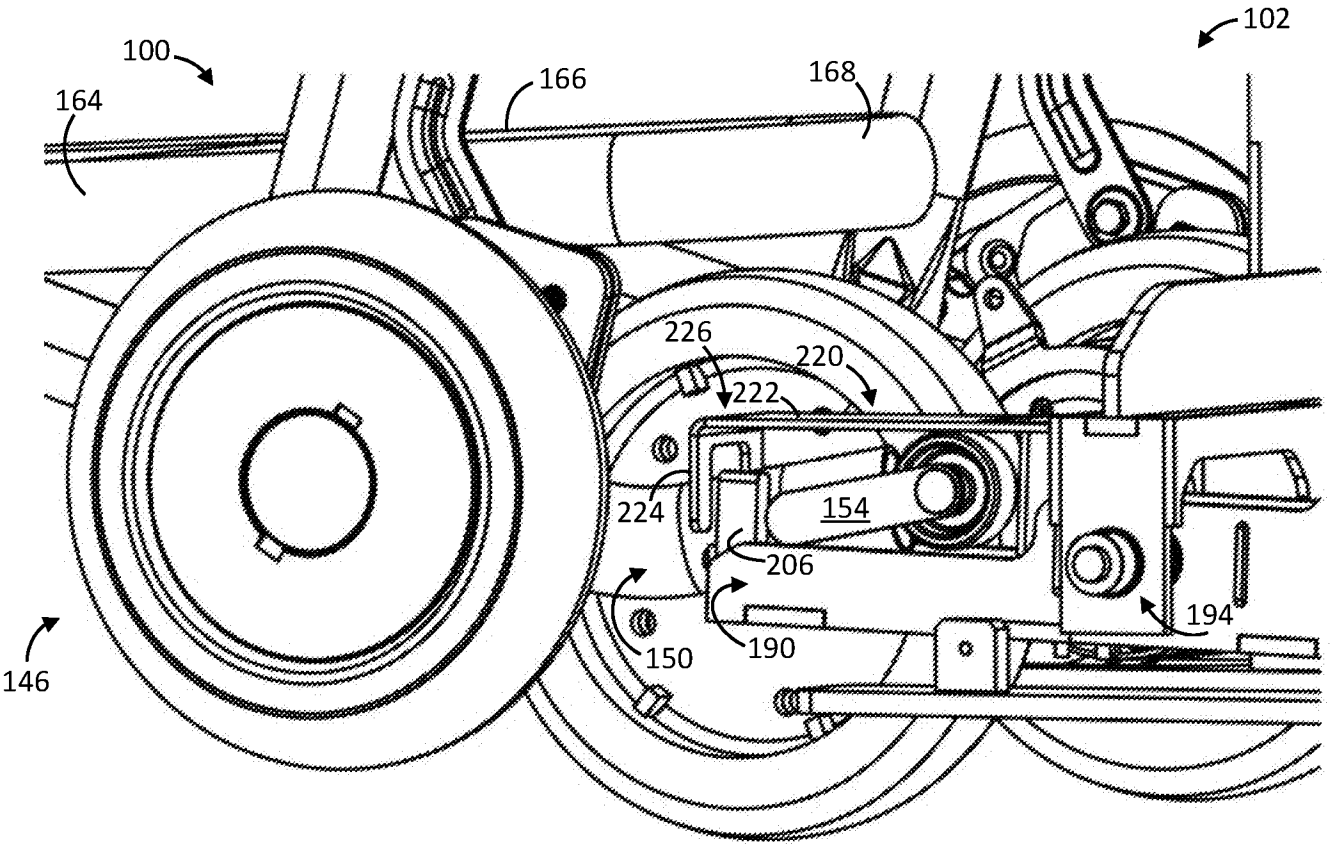
FIG. 3J shows an enlarged perspective view of section 3J of FIG. 3I.

In some examples, a single lifting motor 196 may be used to move each of the first and second lower arm members from their lowered positions to their raised position. For example, as shown in FIG. 3D, the hydraulic actuating cylinder 198 may connect to a central region of a crossbar 214 extending between the first lower arm member 190 and the second lower arm member. In other examples, the apparatus 102 may include two lifting motors 196, one for each of the first and second lower arm members.

Referring to FIG. 1D, the apparatus 102 may include a sensor 216 operable to send a signal to a user when the wheelchair 100 is in the engageable position. The sensor 216 may be a proximity sensor or a contact sensor. For example, the sensor may be a reed switch or a force plate positioned on the apparatus 102 such that when the apparatus 102 is in the engageable position, a portion of the wheelchair 100 contacts the sensor, indicating that the apparatus is in the engageable position. In the example illustrated, the sensor 216 is a force plate 218 connected to the first lower arm member 190. As shown in FIG. 1B, when in the engageable position, the anti-tip bar 150, specifically the anti-tip bar wheel 152, may press against the force plate 218. The sensor 216 may register this contact and a signal may be sent to an operator of the apparatus 102 indicating to the operator that the apparatus 102 is in the engageable position.

In examples of the apparatus 102 having first and second lower arm members, it may be possible to position the wheelchair 100 relative to the apparatus 102 such that the sensor 216 detects the first lower arm member 190 as being in the correct position even though the second lower arm member is not in the correct position. Accordingly, it may be desirable to include sensors 216 associated with each of the first and second lower arm members.

In some examples, the sensor(s) 216 may not be a force plate 218, and rather, may be, for example, an optical position sensor such as an infrared sensor, a magnetostrictive position sensor, an ultrasonic sensor, or any other type of proximity sensor.

In some examples of the apparatus 102, the sensor 216 may be operable to automatically send a signal to the lifting motor 196 when the wheelchair 100 is in the engageable position. That is, in some examples, when the wheelchair 100 is in the engageable position, the sensor 216 may signal the lifting motor 196 to move the first lower arm member 190 from the lowered position to the raised position.

Alternately, or in addition, drive handle 244 may include a switch operable by a care person to move the lower arm member(s) to the raised position when apparatus 102 is in the wheelchair engaging position. Accordingly, upon apparatus 102 issuing a signal indicative of apparatus 102 being in the wheelchair engaging position, a care person may actuate a switch (e.g., a push button or rocker switch) to send a signal to the lifting motor 196 to move the lower arm member(s) to the raised position.

Optionally, apparatus 102 may include a securing member to inhibit the lower arm member(s) 190 from moving from the lowered position to the raised position until the wheelchair 100 is in the engageable position. In some examples, the securing member may be a sensor that sends a signal to the lifting motor 196 inhibiting operation of the lifting motor 196 until the sensor sends a signal to the lifting motor 196 indicative that the wheelchair 100 is in the engageable position. In some examples, the sensor that sends a signal to the lifting motor 196 to inhibit operation of the lifting motor may be the same sensor 216 used to determine if the wheelchair 100 is in the engageable position.

Optionally, apparatus 102 may include a securing member that cooperates with one or both of the lower arm members to inhibit and, optionally prevent, the wheelchair 100 from moving vertically with respect to the apparatus 102 (e.g., if the wheelchair 100 jumps when passing over a bump, the securing member may stop the anti-tip bar 150 from moving out of the U-shaped opening of flange 206). In some examples, the securing member may be a member which surrounds the same engagement surface that lower arm member(s) 190 engage or close the top of the U-shaped opening of flange 206.

Figure 2A:
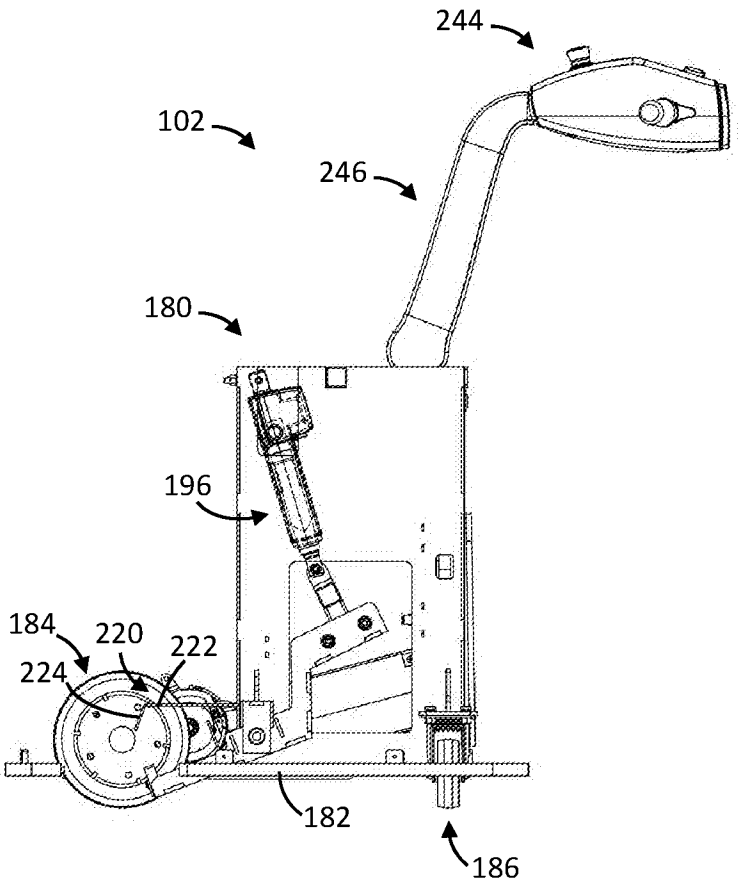
FIG. 2A shows a side view of another apparatus for moving a wheelchair and a wheelchair, wherein a portion of the apparatus is shown transparent and wherein the wheelchair is spaced forwardly of the apparatus.
Figure 2A:
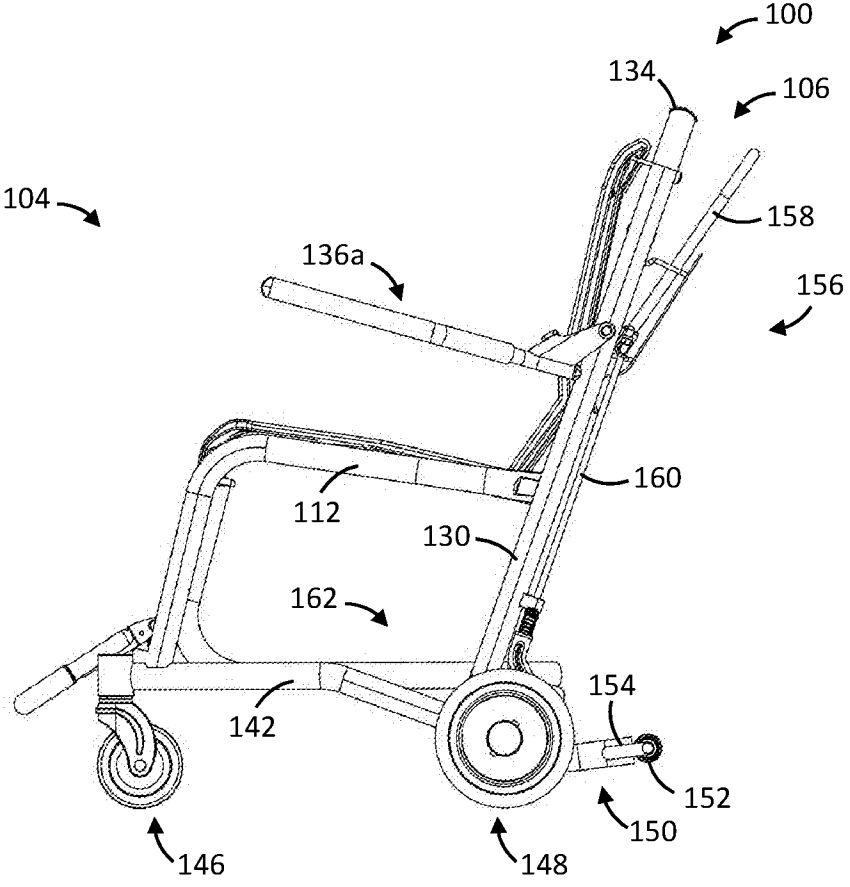
Figure 2B:
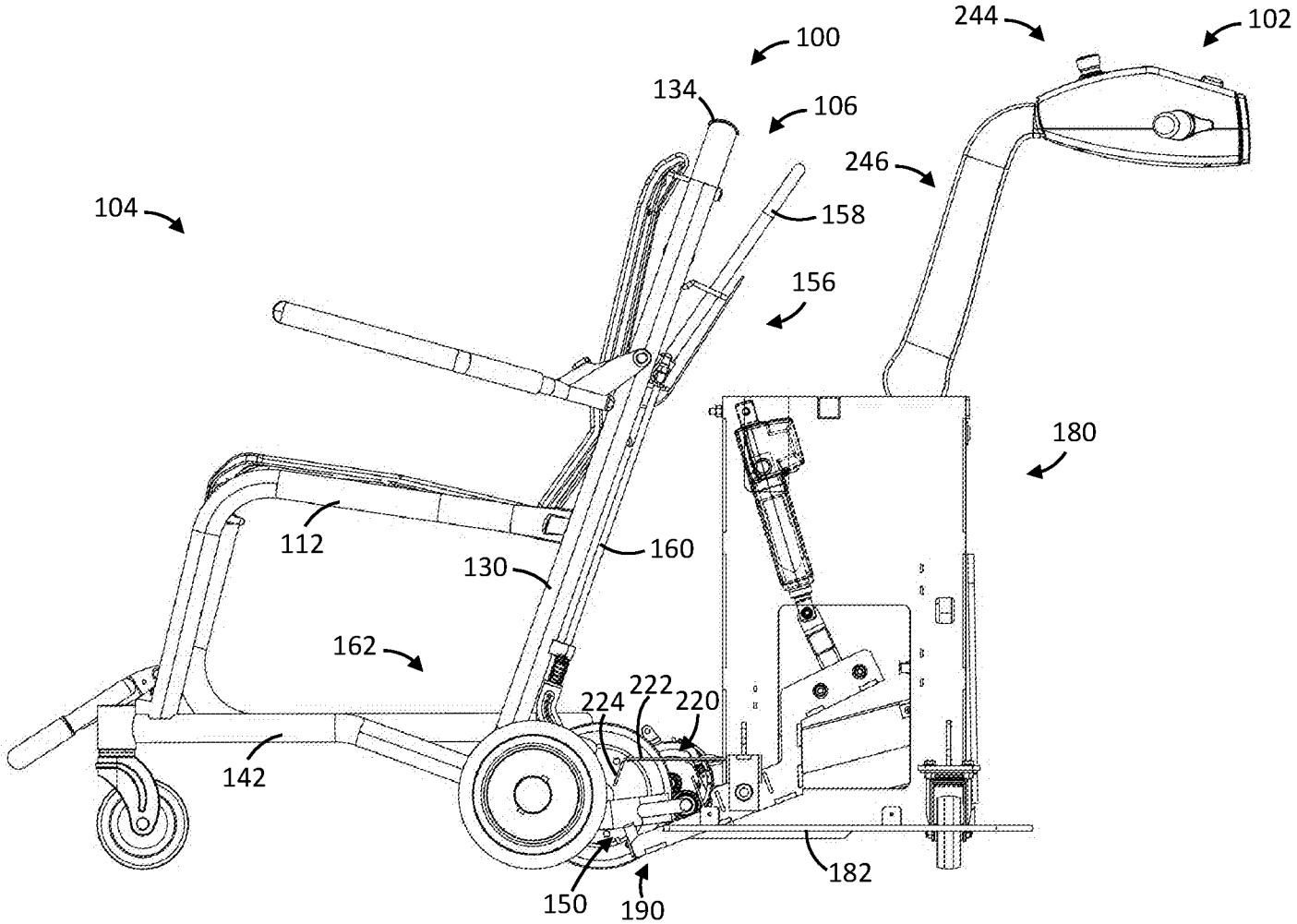
FIG. 2B shows a side view of the apparatus for moving a wheelchair and the wheelchair of FIG. 2A, wherein the apparatus is in a wheelchair engaging position.
Figure 2C:
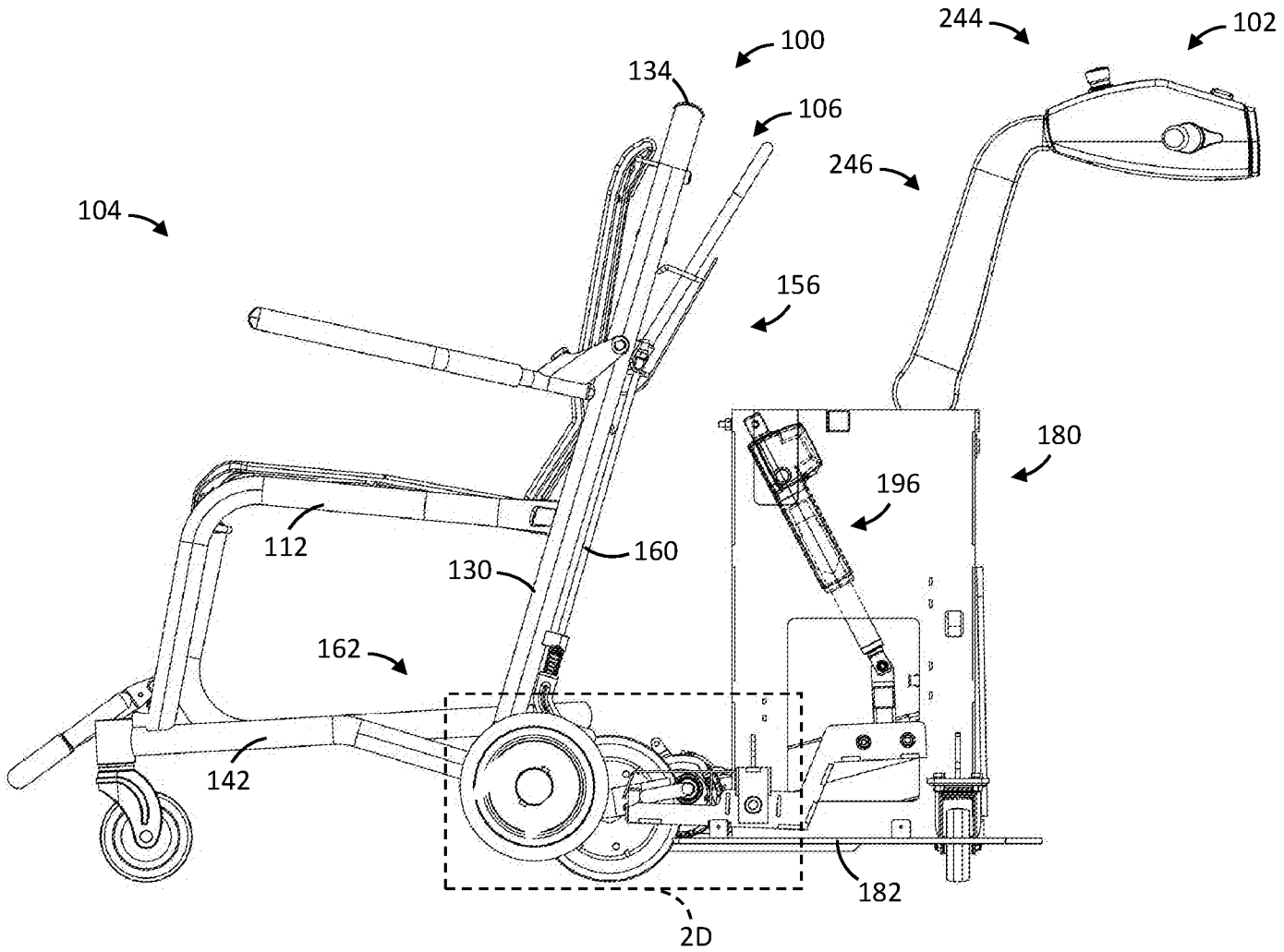
FIG. 2C shows a side view of the apparatus for moving a wheelchair and the wheelchair of FIG. 2A, wherein the wheelchair is engaged by the apparatus.
Figure 2D:
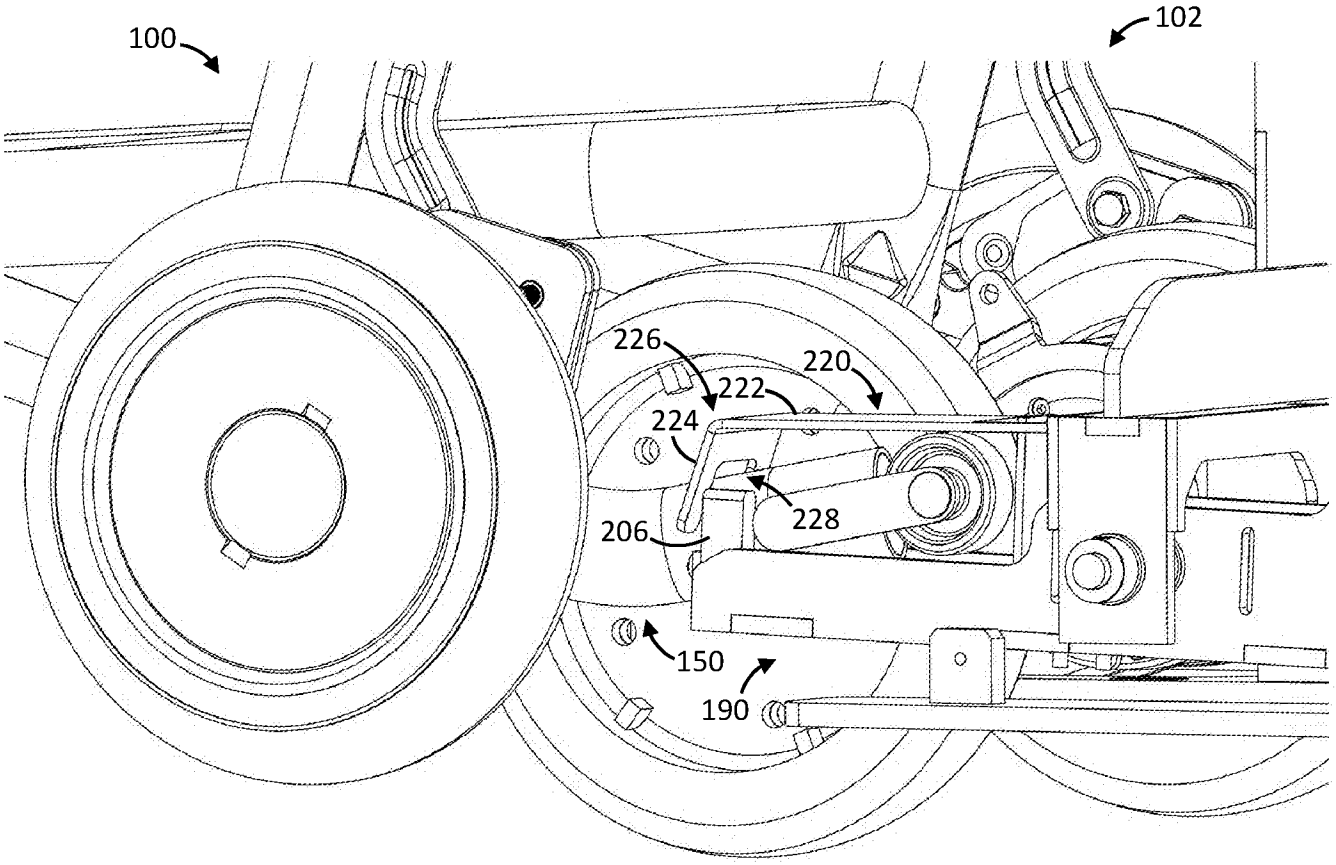
FIG. 2D shows an enlarged perspective view of section 2D of FIG. 2C.

As exemplified in FIG. 2A, the apparatus 102 may include a first upper arm member 220. The first upper arm member 220 may extend from a portion of the frame 182 above a portion of the first lower arm member 190. Referring to FIG. 2D, in the example illustrated, the first upper arm member 220 may include a forwardly extending portion 222 and downwardly extending flange 224. The downwardly extending flange 224 may extend from a forward distal end 226 of the forwardly extending portion 222. In the example illustrated, the downwardly extending flange 224 has a generally U-shaped opening 228. As shown in FIG. 2D, in some examples, when the first lower arm member 190 is in the raised position, the downwardly extending flange 224 of the first upper arm member 220 may be located forward of the upwardly extending flange 206 of the first lower arm member 190. That is, in the example illustrated, when the first lower arm member 190 is in the raised position and engages the wheelchair 100, the first anti-tip bar 150 is located in the generally U-shaped opening 228 of the downwardly extending flange 224 and the U-shaped opening of the upwardly extending flange 206.

The first upper arm member 220 in combination with the first lower arm member 190 may limit the vertical displacement of the wheelchair 100 with respect to the apparatus 102. Accordingly, the first upper arm member 220 in combination with the first lower arm member 190 may stop the wheelchair 100 from becoming inadvertently disengaged from the apparatus 102 during use. Since the apparatus 102 may be used on surfaces that may be inclined, declined, or slanted one way or the other, the first lower arm member 190 and the first upper arm member 220 may not restrict all relative movement between the wheelchair 100 and the apparatus 102. That is, in the example illustrated, when the only front wheels 146 of the wheelchair 100 encounter a forwardly extending declined surface, the downward movement of the front wheels 146 of the wheelchair 100 will cause the anti-tip bar wheel 152 to move upwardly as the stopping member 202 may act as longitudinal fulcrum. Accordingly, sufficient clearance between the first lower arm member 190 and the first upper arm member 220 may be required to permit this type of movement. In some examples, this clearance may be at least partially provided for by a cutout in the forwardly extending portion 222. That is, the forwardly extending portion 222 may include a slot to allow the anti-tip bar wheel 152 to move upwardly with respect to the forwardly extending portion 222.

Figure 4A:
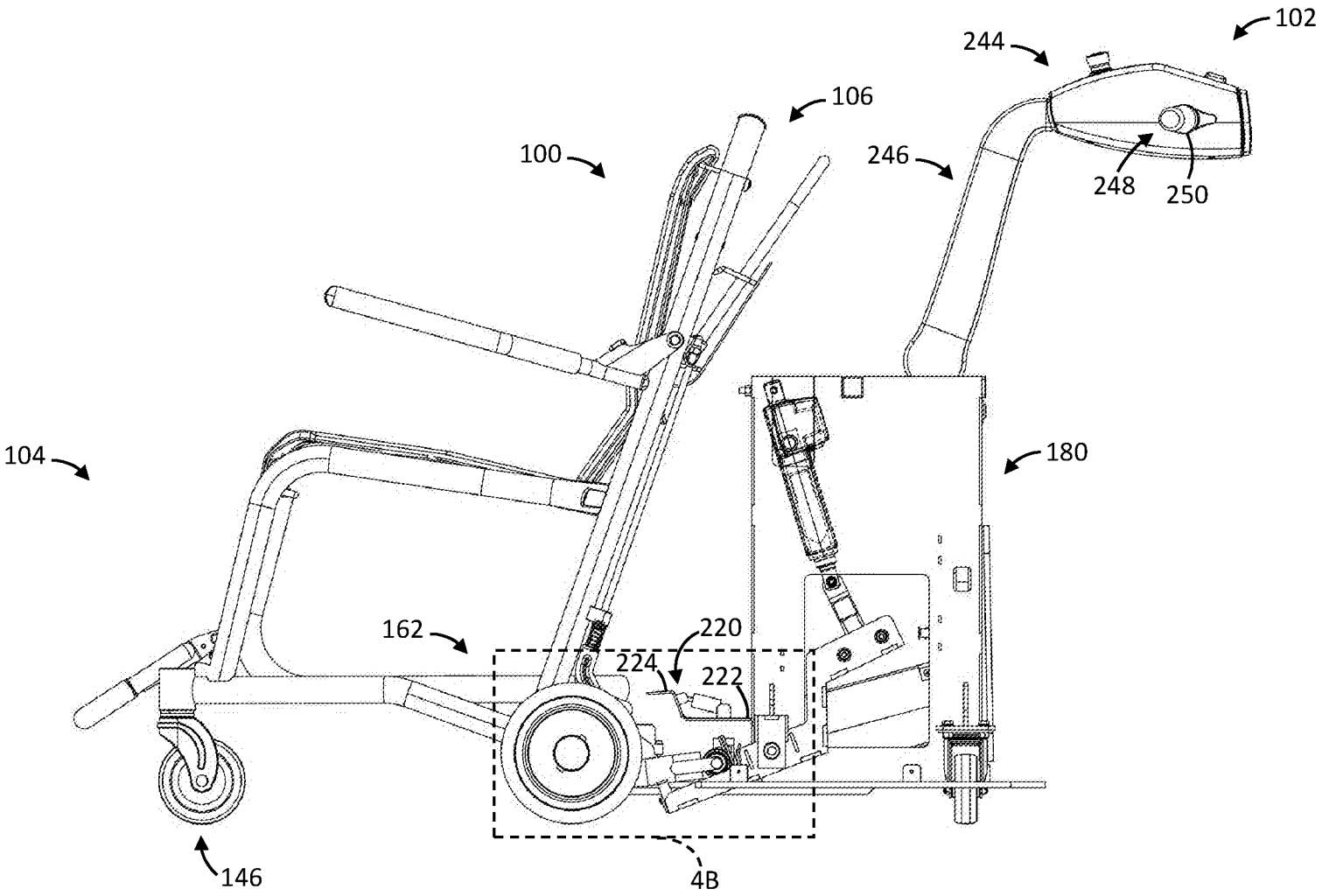
FIG. 4A shows a side view of another apparatus for moving a wheelchair and a wheelchair, wherein the apparatus is in a wheelchair engaging position.

Referring now to FIG. 2A, the downwardly extending flange 224 may extend at an angle relative to the forwardly extending portion 222 of the first upper arm member 220. In other examples, referring now to FIG. 3A, the downwardly extending flange 224 may extend relatively perpendicular to the forwardly extending portion 222 of the first upper arm member 220. In yet another example, referring now to FIG. 4A, the downwardly extending flange 224 may be pivotally attached to the forwardly extending portion 222 of the upper arm member 220 or may be of any other construction discussed with respect to flange 206.

Figure 4B:
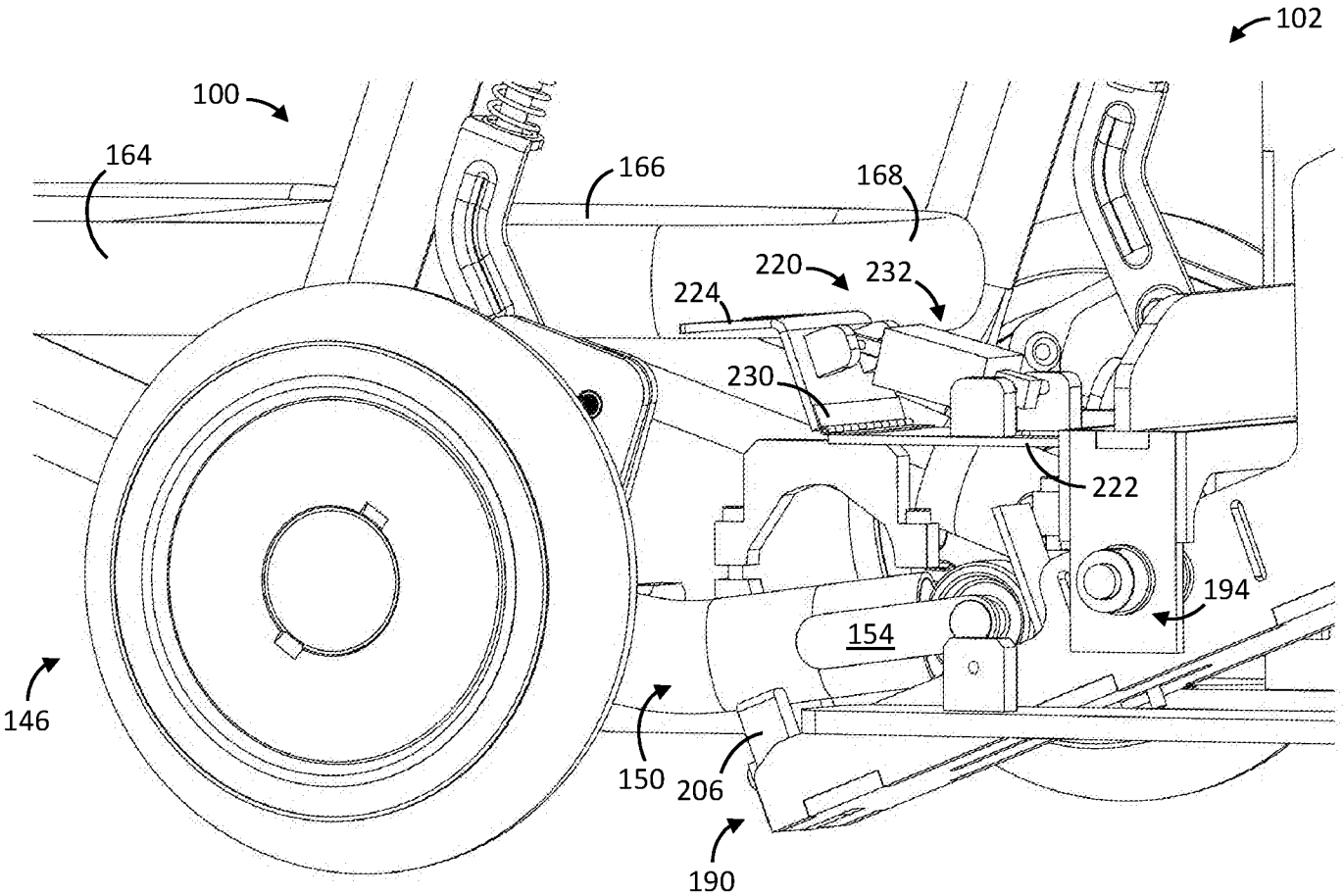
FIG. 4B shows an enlarged perspective view of section 4B of FIG. 4A.
Figure 4C:
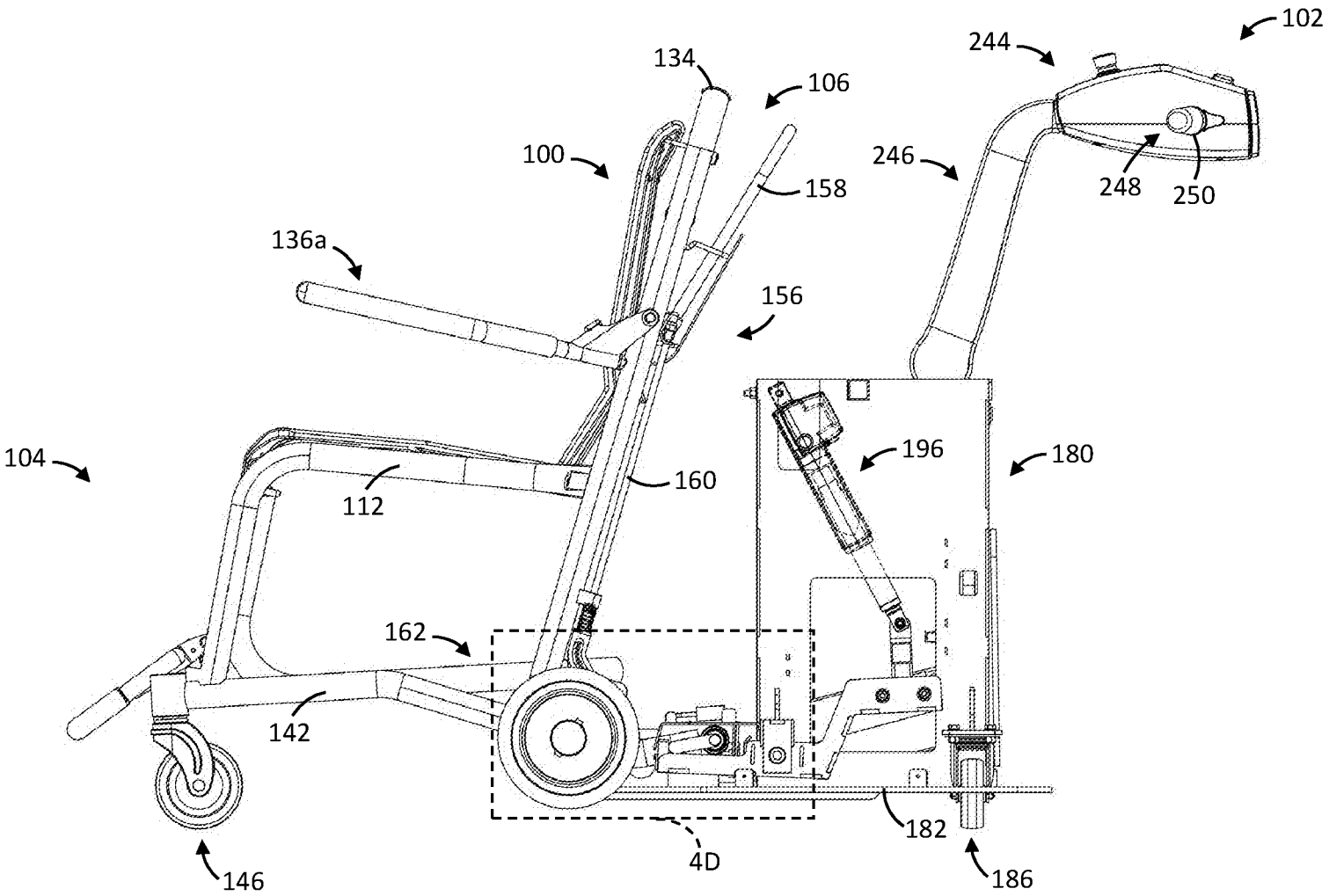
FIG. 4C shows a side view of the apparatus for moving a wheelchair and the wheelchair of FIG. 4A, wherein the wheelchair shown is engaged by the apparatus.
Figure 4D:
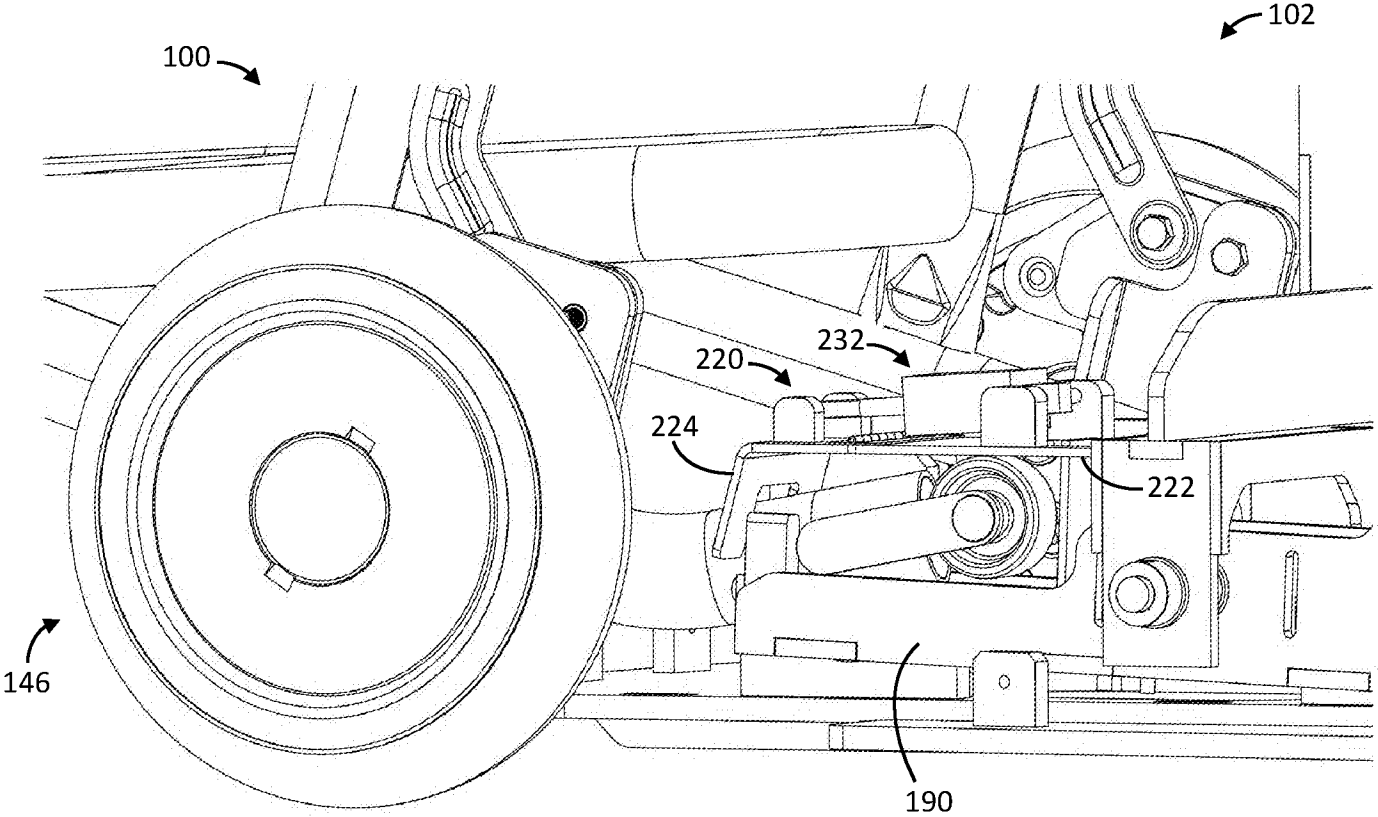
FIG. 4D shows an enlarged perspective view of section 4D of FIG. 4C.

Referring to FIG. 4B, the downwardly extending flange 224 may be pivotally attached to the forwardly extending portion 222 of the first upper arm member 220 by a hinge 230. An actuator 232 may be connected to the downwardly extending flange 224 to pivot the downwardly extending flange 224 between a raised position (as shown in FIG. 4B) and a lowered position (as shown in FIG. 4D). In such a case, the drive handle 244 may include controls for signaling the actuator 232. Alternately, the actuator may be actuated concurrently with or subsequent to the actuation of lifting motor 196 to move lower arm member(s).

Optionally, a second upper arm member (not shown) may be associated with the second lower arm member.

Figure 5A:
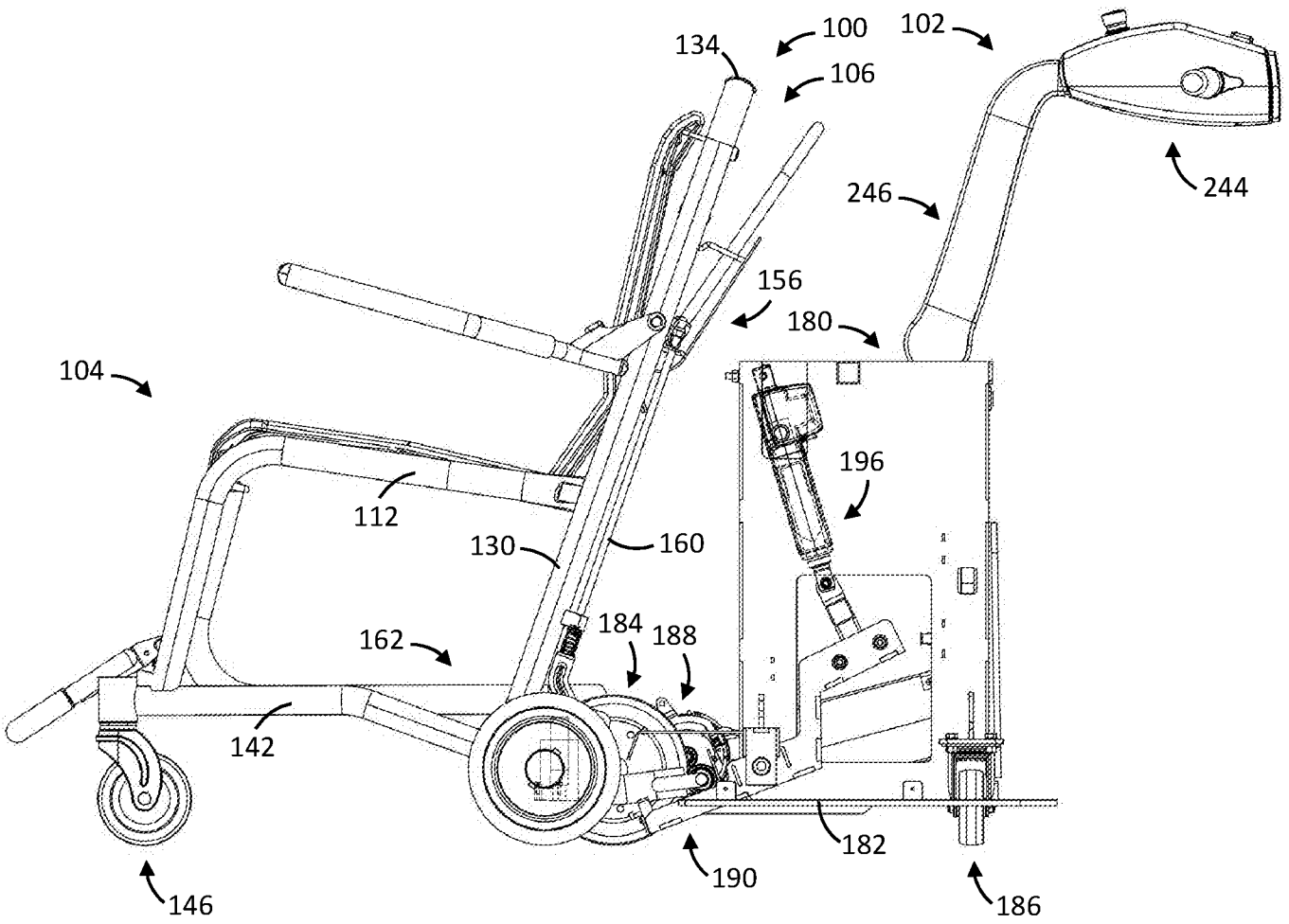
FIG. 5A shows a side view of another apparatus for moving a wheelchair and a wheelchair, wherein the apparatus is in a wheelchair engaging position.
Figure 5B:
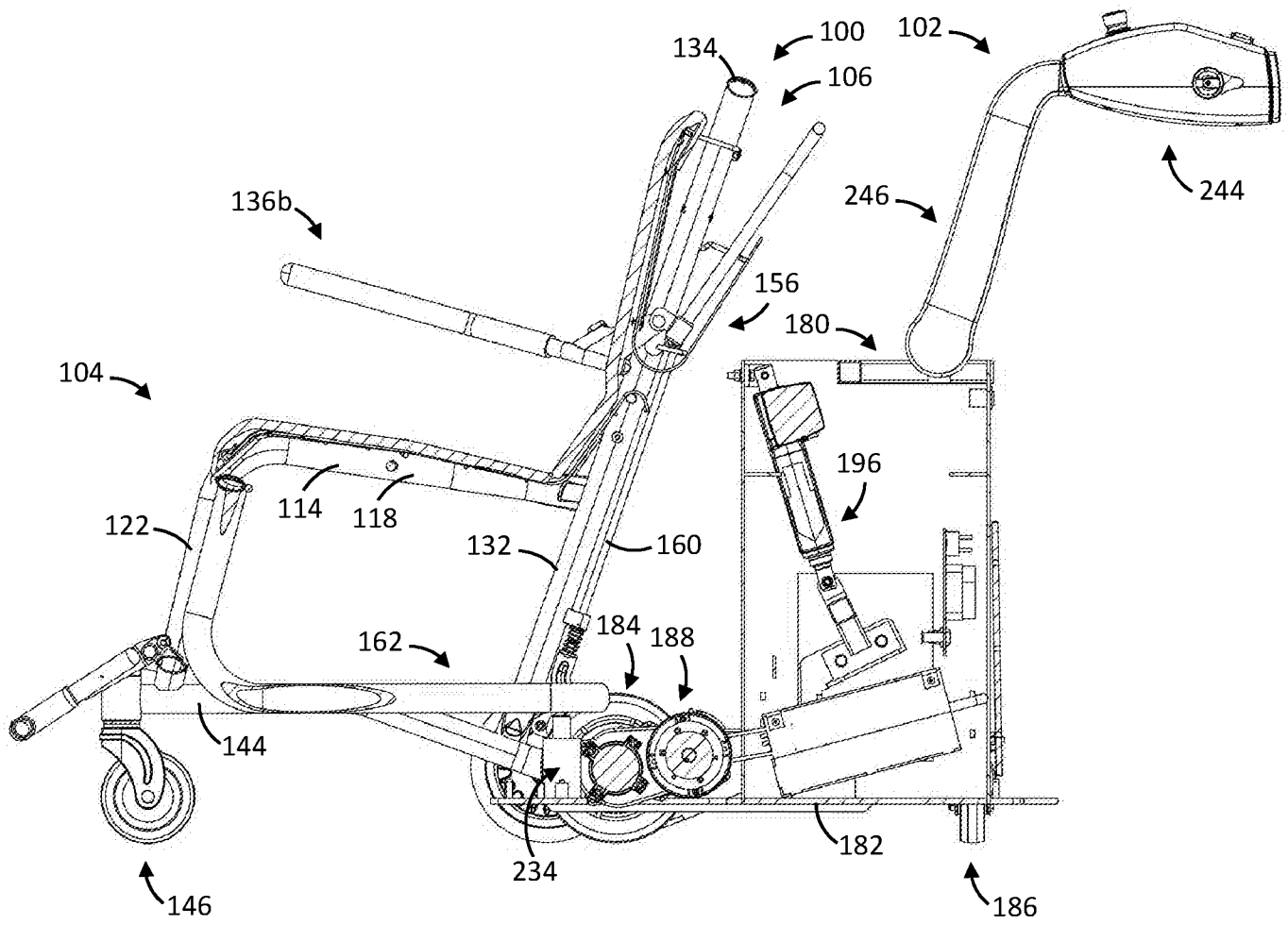
FIG. 5B shows a vertical cross-sectional view of the apparatus for moving a wheelchair and the wheelchair of FIG. 5A.
Figure 5C:
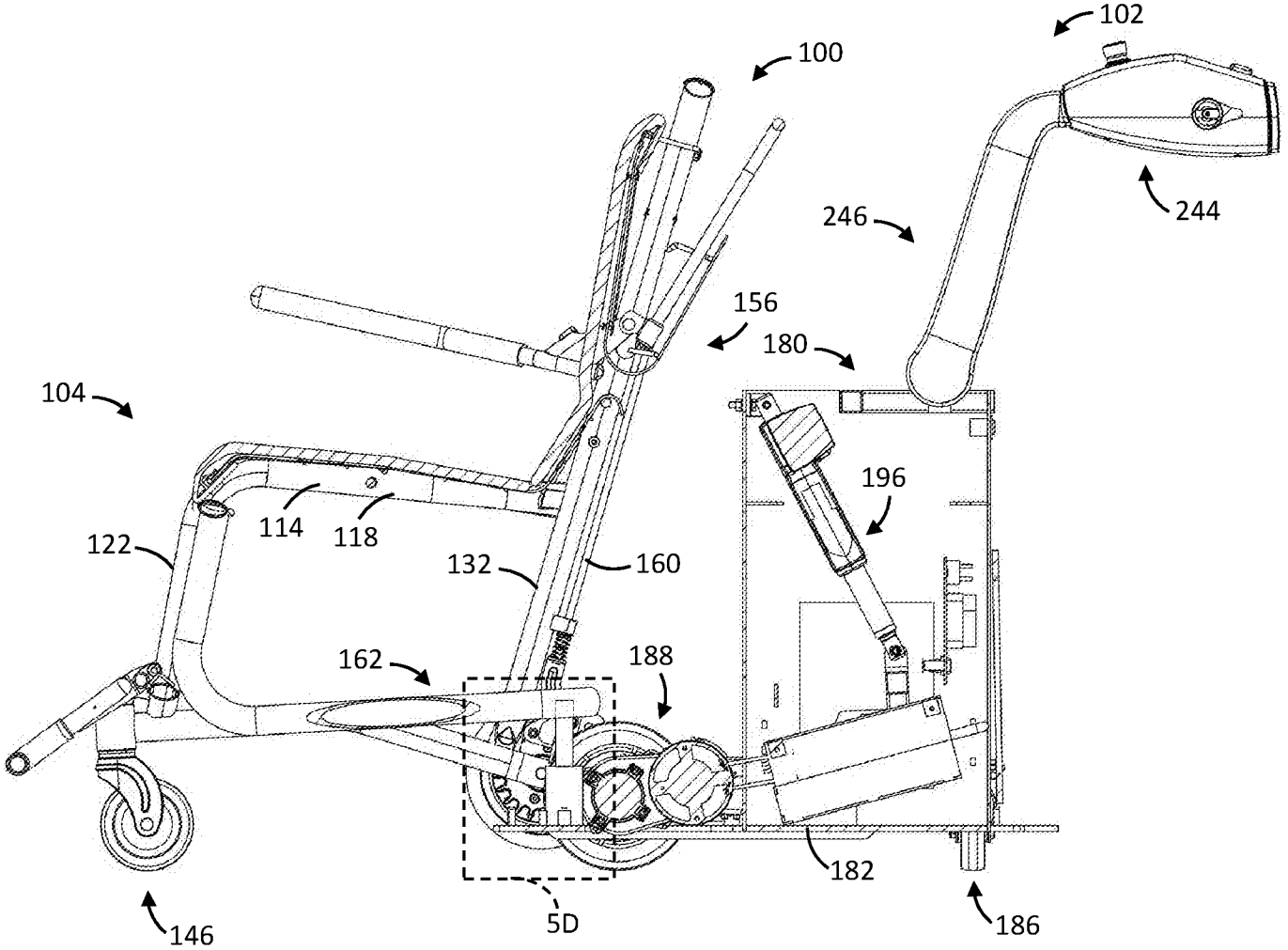
FIG. 5C shows a vertical cross-sectional view of the apparatus for moving a wheelchair and the wheelchair of FIG. 5A, wherein the wheelchair is shown engaged to the apparatus.
Figure 5D:
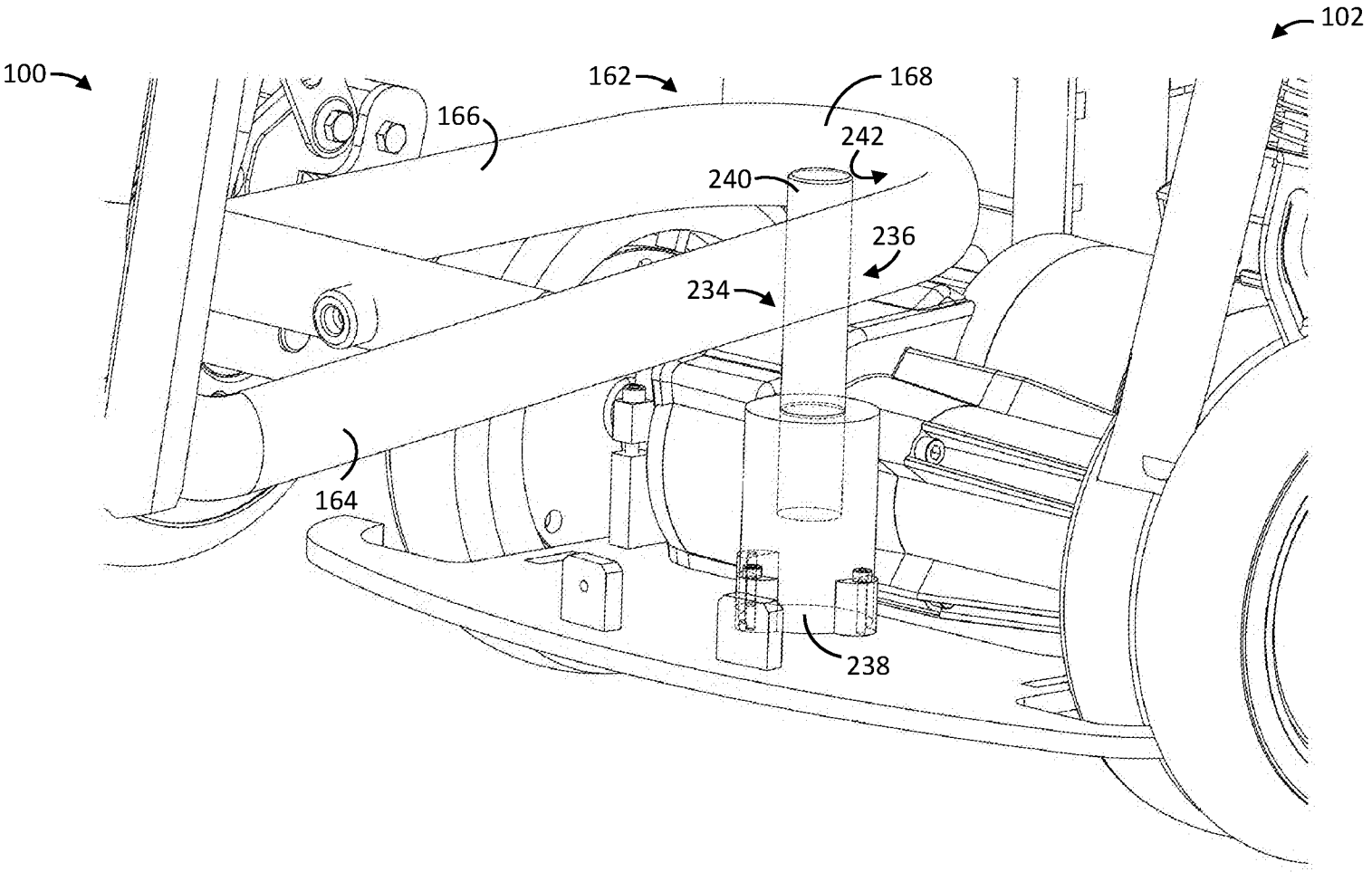
FIG. 5D shows an enlarged perspective view of section 5D of FIG. 5C.

Optionally, as exemplified in FIG. 5B, the apparatus 102 may include an upwardly extending second stop member 234. As shown, the second stop member 234 may be a vertically translatable rod 236. As exemplified in FIG. 5D, the second stop member 234 is a telescoping member (e.g., a hydraulic actuating cylinder 238 having an extendable and retractable piston rod 240). The second stop member 234 may inhibit forward movement of the wheelchair 100 relative to the apparatus 102 by extending the piston rod 240 forward of an abutment surface 242 on the wheelchair 100 when the wheelchair 100 is in the engaged position. It will be appreciated that apparatus 102 may have an upwardly extending second stop member 234 and not including a first lower arm member 190 and/or first stop member 202 as described previously.

For example, as described above and still referring to FIG. 5D, in some embodiments of the wheelchair 100, the wheelchair 100 may include a luggage rack 162 having a cross member 168. In this example, when the wheelchair 100 is in the engageable position, the upwardly extending second stop member 234 may be positionable forward of the cross member 168 of the luggage rack 162. Further, the second stop member 234 may be positionable at an elevation of the cross member 168 of the luggage rack 162. Accordingly, in this example, when the wheelchair 100 is on a forwardly extending declined surface, forward motion of the wheelchair 100 relative to the apparatus 102 may be inhibited by engagement between the cross member 168 and the second stop member 234.

In some examples, if both the second stop member and the lower arm 190 are provided, the second stop member 234 may be positionable forward of the cross member 168 of the luggage rack 162 concurrently with the first lower arm member 190 moving to the raised position. In other examples, the upwardly second stop member 234 may positionable forward of the cross member 168 of the luggage rack 162 subsequent to the first lower arm member 190 moving to the raised position. In yet another example, the second stop member 234 may be automatically positionable, and may be controlled by the sensor 216 for determining whether the wheelchair 100 is in the engageable position. That is, in some examples, upon the sensor 216 registering that the wheelchair 100 is in the engageable position, the sensor 216 may first send a signal to position the second stop member 234, i.e., in the example illustrated, extend the piston rod 240, and then the sensor 216 may send a signal to the lifting motor 196 to move the first lower arm member 190 from the lowered position to the raised position.

It will be appreciated that, in alternate examples, second stop member 234 may enter a recess provided in a portion of wheelchair 100 (e.g., a portion of the frame of wheelchair or luggage rack 162 may have an opening into which second stop member 234 is receivable).

It will be appreciated that any actuator or switch may be provided at any location and, optionally on grip portion 248 or drive handle 244, for actuating one or more of the lower arm member(s) and the second stop member(s).

It will be appreciated that the apparatus 102 may include other controls, such as, for example, a key, a horn, an emergency stop, and a slow button. In examples including a drive motor 188, a slow button may be used to limit the speed of the apparatus 102 to a certain percentage of the normal operating speed, as it may be desirable to limit the speed when positioning the apparatus 102 to the engageable position.

While the above description describes features of example embodiments, it will be appreciated that some features and/or functions of the described embodiments are susceptible to modification without departing from the spirit and principles of operation of the described embodiments. For example, the various characteristics which are described by means of the represented embodiments or examples may be selectively combined with each other. Accordingly, what has been described above is intended to be illustrative of the claimed concept and non-limiting. It will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

The invention claimed is:

1. An apparatus for moving a wheelchair, the wheelchair having a front end, a rear end and first and second laterally opposed sides, the wheelchair is positionable in front of the apparatus in an engageable position, the apparatus comprising:

(a) a base comprising a drive motor drivingly connected to a drive wheel and a first forwardly extending lower arm member engageable with the wheelchair when the wheelchair is in the engageable position wherein the first lower arm member is operable between a lowered position in which the first lower arm member is disengaged from the wheelchair and, when the wheelchair is in the engageable position, a raised position in which the first lower arm engages the wheelchair, the first lower arm member has a first stop member whereby, when the first lower arm member is in the raised position and engages the wheelchair, and when the wheelchair is on a forwardly extending declined surface, the first stop member inhibits forward motion of the wheelchair; and, (b) a grip portion provided on a driving linkage wherein the driving linkage is drivingly connected to the base wherein the driving linkage is pivotally mounted to the base and the first lower arm member is moved to the raised position when the driving linkage is pivoted rearwardly.

2. The apparatus of claim 1 further comprising a sensor operable to send a signal to a user when the wheelchair is in the engageable position.

3. The apparatus of claim 1 further comprising a lifting motor that is drivingly connected to the first lower arm member and a sensor operable to automatically send a signal to the lifting motor when the wheelchair is in the engageable position.

4. The apparatus of claim 1 further comprising a securing member inhibiting the first lower arm member moving to the raised position until the wheelchair is in the engageable position.

5. The apparatus of claim 4 wherein the securing member comprises a lifting motor that is drivingly connected to the first lower arm member and a sensor operable to send a signal to the lifting motor to actuate the lifting motor to raise the first lower arm member to the raised position, wherein the lifting motor is inhibited from operation until the sensor sends a signal to the lifting motor indicative that the wheelchair is in the engageable position.

6. The apparatus of claim 1 further comprising at least one steerable wheel.

7. The apparatus of claim 6 wherein the at least one steerable wheel comprises a pair of rear caster wheels.

8. An apparatus for moving a wheelchair, the wheelchair having a front end, a rear end and first and second laterally opposed sides, and first and second laterally spaced apart rearwardly extending anti-tip bars, the wheelchair is positionable in front of the apparatus in an engageable position, the apparatus comprising:

(a) a base comprising a drive motor drivingly connected to a drive wheel and a first forwardly extending lower arm member engageable with the wheelchair when the wheelchair is in the engageable position wherein the first lower arm member is operable between a lowered position in which the first lower arm member is disengaged from the wheelchair and, when the wheelchair is in the engageable position, a raised position in which the first lower arm engages the wheelchair, the first lower arm member has a first stop member whereby, when the first lower arm member is in the raised position and engages the wheelchair, and when the wheelchair is on a forwardly extending declined surface, the first stop member inhibits forward motion of the wheelchair; and, (b) a grip portion provided on a driving linkage wherein the driving linkage is drivingly connected to the base, wherein, when the wheelchair is in the engageable position, the first lower arm member is engageable with the first anti-tip bar and the apparatus has a second lower arm member that is engageable with the second anti-tip bar.

9. The apparatus of claim 8 wherein when the first lower arm member is in the raised position and engages the wheelchair, the first stop member is positioned forward of a wheel mount securing an anti-tip bar wheel to the anti-tip bar.

10. The apparatus of claim 9 wherein the first stop member comprises an upwardly extending flange having a generally U-shaped opening whereby, when the first lower arm member is in the raised position and engages the wheelchair, the first anti-tip bar is located in the generally U-shaped opening and the upwardly extend flange is positioned forward of the wheel mount.

11. The apparatus of claim 10 wherein the apparatus comprises a first upper arm member having a downwardly extending flange having a generally U-shaped opening whereby, when the first lower arm member is in the raised position, the downwardly extending flange of the first upper arm member is located forward of the upwardly extending flange of the first lower arm member.

12. The apparatus of claim 11 wherein, when the first lower arm member is in the raised position and engages the wheelchair, the first anti-tip bar is located in the generally U-shaped opening of the downwardly extending flange.

13. An apparatus for moving a wheelchair, the wheelchair having a front end, a rear end, first and second laterally opposed sides, and a luggage rack having a cross member, the wheelchair is positionable in front of the apparatus in an engageable position, the apparatus comprising:

(a) a base comprising a drive motor drivingly connected to a drive wheel and a first forwardly extending lower arm member engageable with the wheelchair when the wheelchair is in the engageable position wherein the first lower arm member is operable between a lowered position in which the first lower arm member is disengaged from the wheelchair and, when the wheelchair is in the engageable position, a raised position in which the first lower arm engages the wheelchair, the first lower arm member has a first stop member whereby, when the first lower arm member is in the raised position and engages the wheelchair, and when the wheelchair is on a forwardly extending declined surface, the first stop member inhibits forward motion of the wheelchair; and, (b) a grip portion provided on a driving linkage wherein the driving linkage is drivingly connected to the base; and (c) an upwardly extending second stop member wherein, when the wheelchair is in the engageable position, the upwardly extending second stop member is positionable forward of the cross member of the luggage rack and at an elevation of the cross member of the luggage rack whereby when the wheelchair is on a forwardly extending declined surface forward motion of the wheelchair is inhibited by engagement between the cross member and the upwardly extending second stop member.

14. The apparatus of claim 13 wherein the upwardly extending second stop member comprises a vertically translatable rod.

15. The apparatus of claim 13 wherein the upwardly extending second stop member is positionable forward of the cross member of the luggage rack concurrently with the first lower arm member moving to the raised position.

16. The apparatus of claim 13 wherein the upwardly extending second stop member is positionable forward of the cross member of the luggage rack subsequent to the first lower arm member moving to the raised position.

17. An apparatus for moving a wheelchair, the wheelchair having a front end, a rear end and first and second laterally opposed sides, the wheelchair is positionable in front of the apparatus in an engageable position, the apparatus comprising:

(a) a base comprising a drive motor drivingly connected to a drive wheel and a first forwardly extending lower arm member having an uninterrupted surface that extends to a fixed upwardly extending flange provided at a distal end of the uninterrupted surface, wherein the first lower arm member is operable between a lowered position in which the first lower arm member is disengaged from the wheelchair and, when the wheelchair is in the engageable position, a raised position in which the fixed upwardly extending flange is positioned forward of an engagement portion of the wheelchair and a rear end of the wheelchair is supported by the uninterrupted surface, and when the wheelchair is on a forwardly extending declined surface, the fixed upwardly extending flange inhibits forward motion of the wheelchair; and, (b) a grip portion provided on a driving linkage wherein the driving linkage is drivingly connected to the base.

18. The apparatus of claim 17, wherein the first lower arm member is pivotable between the lowered position and the raised position.

19. The apparatus of claim 17, wherein (a) an upper surface of the drive wheel is spaced a first distance from a ground surface;

(b) the first lower arm member is spaced a second distance from the ground surface when in the raised position; and, (c) the second distance is less than the first distance.

20. The apparatus of claim 17, wherein the uninterrupted surface and the upwardly extending flange define a L-shaped member.

* * * * *